US007320366B2

(12) United States Patent
Steele et al.

(10) Patent No.: US 7,320,366 B2
(45) Date of Patent: Jan. 22, 2008

(54) ASSEMBLY OF DOWNHOLE EQUIPMENT IN A WELLBORE

(75) Inventors: David J. Steele, Irving, TX (US); Jody R. McGlothen, Waxahachie, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 319 days.

(21) Appl. No.: 11/058,508

(22) Filed: Feb. 15, 2005

(65) Prior Publication Data

US 2006/0180316 A1 Aug. 17, 2006

(51) Int. Cl.
*E21B 43/00* (2006.01)
*E21B 23/00* (2006.01)

(52) U.S. Cl. ..... 166/381; 166/313; 166/50; 166/117.5; 166/206

(58) Field of Classification Search ..... None
See application file for complete search history.

(56) References Cited

U.S. PATENT DOCUMENTS

| | | | |
|---|---|---|---|
| 2,314,540 | A | 3/1943 | Huntington |
| 4,982,625 | A | 1/1991 | Bonner |
| 5,141,051 | A | 8/1992 | Lenhart |
| 5,318,122 | A | 6/1994 | Murray et al. |
| 5,330,007 | A | 7/1994 | Collins et al. |
| 5,337,823 | A | 8/1994 | Nobileau |
| 5,340,626 | A | 8/1994 | Head |
| 5,350,481 | A | 9/1994 | Shepard et al. |
| 5,358,418 | A | 10/1994 | Carmichael |
| 5,388,648 | A | 2/1995 | Jordan, Jr. |
| 5,425,559 | A | 6/1995 | Nobileau |
| 5,479,986 | A | 1/1996 | Gano et al. |
| 5,613,557 | A | 3/1997 | Blount et al. |
| 5,655,602 | A | 8/1997 | Collins |
| 5,695,008 | A | 12/1997 | Bertet et al. |
| 5,718,288 | A | 2/1998 | Bertet et al. |
| 5,794,702 | A | 8/1998 | Nobileau |
| 5,817,737 | A | 10/1998 | Mariaggi et al. |
| 5,823,257 | A | 10/1998 | Peyton |
| 5,964,288 | A | 10/1999 | Leighton |
| 5,979,560 | A | 11/1999 | Nobileau |
| 6,026,903 | A | 2/2000 | Shy et al. |
| 6,056,059 | A | 5/2000 | Ohmer |
| 6,089,320 | A | 7/2000 | LaGrange |

(Continued)

FOREIGN PATENT DOCUMENTS

| | | |
|---|---|---|
| GB | 2275286 | 8/1994 |

(Continued)

OTHER PUBLICATIONS

Office Action for U.S. Appl. No. 10/773,899 dated Apr. 13, 2006.

(Continued)

*Primary Examiner*—Frank Tsay
(74) *Attorney, Agent, or Firm*—Marlin R. Smith

(57) ABSTRACT

A system and method for assembly of downhole equipment in a subterranean well. In a described embodiment, a method of assembling an apparatus in a subterranean well includes the steps of: positioning an expandable shell in the well; expanding the shell in the well; and then interconnecting multiple portions of the apparatus to each other within the expanded shell.

30 Claims, 16 Drawing Sheets

U.S. PATENT DOCUMENTS

| | | | | |
|---|---|---|---|---|
| 6,189,616 | B1 | 2/2001 | Gano et al. | |
| 6,252,852 | B1 | 6/2001 | Rowles et al. | |
| 6,253,846 | B1 | 7/2001 | Nazzai | |
| 6,253,850 | B1 | 7/2001 | Nazzai et al. | |
| 6,253,852 | B1 | 7/2001 | Nobileau | |
| 6,283,209 | B1 | 9/2001 | Keller | |
| 6,315,040 | B1 | 11/2001 | Donnelly | |
| 6,336,507 | B1 | 1/2002 | Collins | |
| 6,425,444 | B1 * | 7/2002 | Metcalfe et al. | 166/387 |
| 6,439,932 | B1 | 8/2002 | Ripolone | |
| 6,564,867 | B2 | 5/2003 | Ohmer | |
| 6,648,075 | B2 | 11/2003 | Badrak et al. | |
| 6,703,095 | B2 | 3/2004 | Busshoff et al. | |
| 6,719,064 | B2 * | 4/2004 | Price-Smith et al. | 166/387 |
| 6,772,841 | B2 | 8/2004 | Gano | |
| 6,932,161 | B2 * | 8/2005 | Cameron | 166/384 |
| 2002/0033261 | A1 | 3/2002 | Metcalfe | |
| 2005/0087345 | A1 | 4/2005 | Steele | |

FOREIGN PATENT DOCUMENTS

| | | |
|---|---|---|
| GB | 2353811 | 3/2001 |
| GB | 2395210 | 5/2004 |
| GB | 2397600 | 7/2004 |
| WO | WO 98/09054 | 3/1998 |
| WO | WO 99/13195 | 3/1999 |
| WO | WO 00/26501 | 5/2000 |
| WO | WO 00/50733 | 8/2000 |
| WO | WO 02/29207 | 4/2002 |
| WO | WO 02/29208 | 4/2002 |

OTHER PUBLICATIONS

Office Action for U.S. Appl. No. 10/997,619 dated Sep. 14, 2005.
Search Report for United Kingdom application No.: GB0401224.1, Aug. 4, 2004.
Search Report for United Kingdom application No.: GB0502350.2, Apr. 11, 2005.
U.S. Appl. No. 10/773,899 filed Feb. 6, 2004.
Schlumberger, "WCF Wet Connect Firing Systems", 2 pgs., 2004.
AnTech, "Coiled Tubing Downhole Tools", 4 pgs., 2001.
Properties Energetic Materials, "Explosive Welding and Cladding of Metals", undated.
Southern Illinois University, RTM Related Processes, dated 2000.
High Energy Metals, Inc., "Explosion Bonding Engineering and Design Basics", dated Mar. 8, 2000.

* cited by examiner

ASSEMBLY OF DOWNHOLE EQUIPMENT IN A WELLBORE

BACKGROUND

The present invention relates generally to equipment utilized and operations performed in conjunction with a subterranean well and, in an embodiment described herein, more particularly provides a system and method for assembly of downhole equipment in a wellbore.

It is known to expand vessels, such as wellbore junctions, in wellbores. Unfortunately, such expanded vessels typically suffer from inadequate burst and collapse resistance, due in part to the fact that their walls are usually made thin and flexible so that they can be relatively easily deformed.

Therefore, it may be seen that it would be beneficial to provide improved systems and methods for constructing and utilizing equipment, such as expandable equipment, in wellbores. These systems and methods could find use in other applications, as well.

SUMMARY

In carrying out the principles of the present invention, in accordance with an embodiment thereof, a system and method are provided for assembling equipment in a well. An apparatus is assembled using multiple portions of the apparatus interconnected to each other in an expanded shell.

In one aspect of the invention, a system for assembling an apparatus in a subterranean well includes an expandable shell interconnected in a tubular string. Multiple portions of the apparatus are conveyed through the tubular string into the shell. The apparatus portions are assembled within the shell, thereby forming the apparatus.

In another aspect of the invention, a system includes an expandable shell and multiple portions of the apparatus assembled in the shell. The apparatus portions are assembled in the shell after the shell is expanded in the well. The assembled apparatus portions form the apparatus.

In yet another aspect of the invention, a method of assembling an apparatus in a subterranean well includes the steps of: positioning an expandable shell in the well; expanding the shell in the well; and then interconnecting multiple portions of the apparatus to each other within the expanded shell.

In a preferred embodiment of the invention, the apparatus is a wellbore junction. Interior portions of the wellbore junction interconnected in an expanded shell have wellbore exit passages formed therein. The interior portions outwardly support the expanded shell, thereby increasing its collapse resistance.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
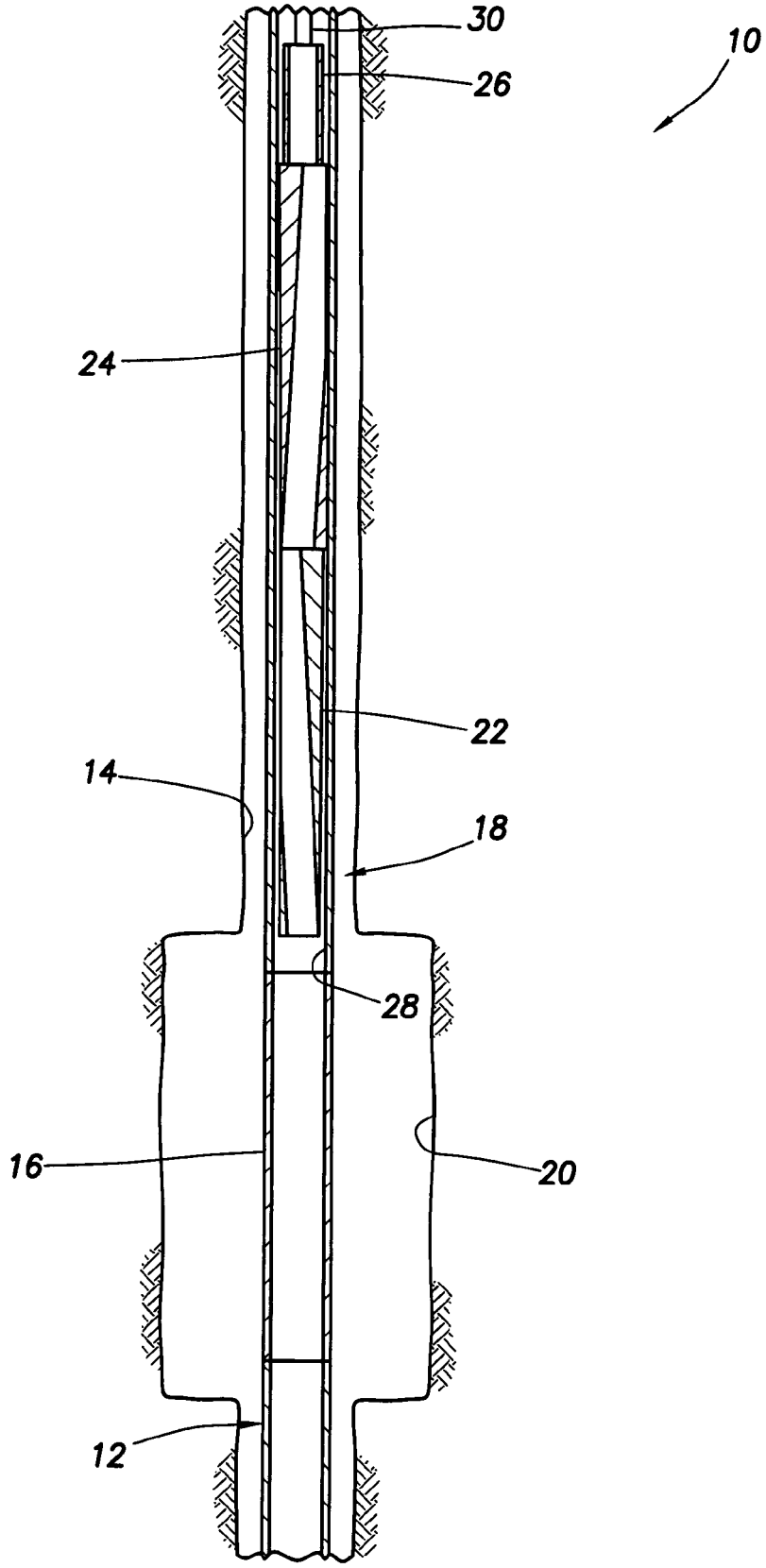
FIG. 1 is a schematic cross-sectional view of a first system for assembling an apparatus embodying principles of the present invention.

Representatively illustrated in FIG. 1 is a system 10 for assembling an apparatus in a well, which system embodies principles of the present invention. In the following description of the system 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which are not limited to any specific details of these embodiments.

As depicted in FIG. 1, a tubular string 12 has been conveyed into a wellbore 14. The tubular string 12 may be a casing string, liner string, tubing string, or any other type of tubular string. The wellbore 14 could be uncased at the time the tubular string 12 is conveyed therein, or the wellbore could be completely or partially cased. The wellbore 14 could be a main or parent wellbore, and/or it could be a branch or lateral of another wellbore.

An expandable shell 16 of a wellbore junction apparatus 18 is interconnected in the tubular string 12. The shell 16 is positioned within a radially enlarged cavity 20 formed in the wellbore 14, for example, by underreaming. However, it is not necessary in keeping with the principles of the invention for the shell 16 to be positioned in an enlarged cavity.

The wellbore junction 18 is in an unassembled configuration as depicted in FIG. 1. In addition to the shell 16, the wellbore junction 18 includes interior portions 22, 24, 26, which are longitudinally distributed within a flow passage 28 of the tubular string 12. The portions 22, 24, 26 could be conveyed into the well within the tubular string 12 when the shell 16 is also conveyed into the well, or the portions could be conveyed into the well after the shell. The portions 22, 24, 26 could be conveyed together, or they could be conveyed separately or individually through the tubular string 12.

A running tool 30 is preferably used to convey the portions 22, 24, 26 together through the tubular string 12. The portions 22, 24, 26 may be conveyed through the tubular string 12 before and/or after the shell 16 is expanded.

Figure 2:
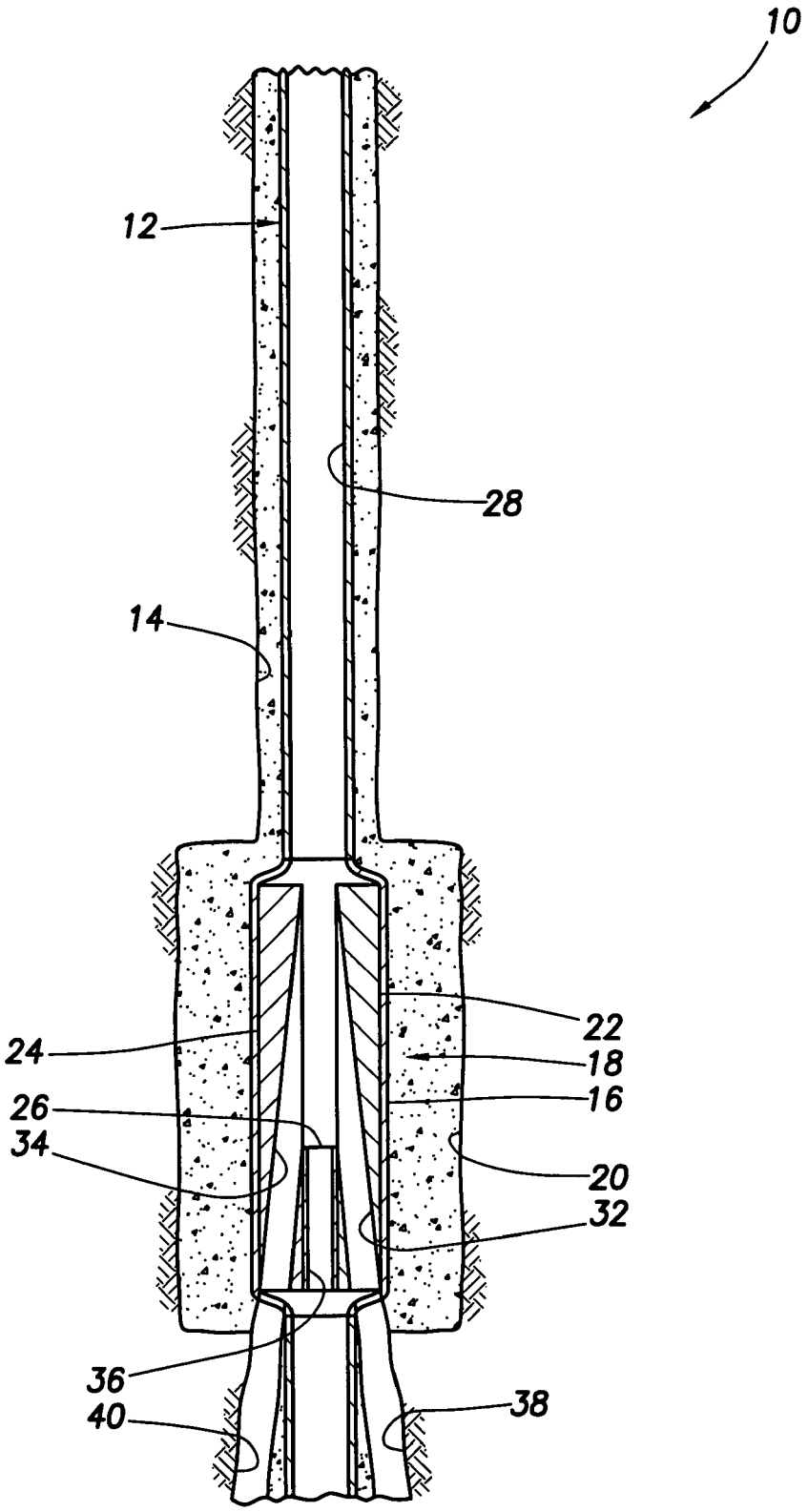
FIG. 2 is a schematic cross-sectional view of FIG. 1, in which additional steps of a first method of assembling the apparatus have been performed, the method embodying principles of the invention.

Referring additionally now to FIG. 2, the system 10 is depicted after the shell 16 has been expanded in the cavity 20. The shell 16 may be expanded using any method or combination of methods, such as by inflating with internal pressure, mechanically forming (e.g., swaging, drifting, etc.), or any other method. The interior portions 22, 24, 26 are then conveyed into the expanded shell 16 to complete the assembly of the wellbore junction 18.

Due to the manner in which the interior portions 22, 24, 26 interconnect with each other within the shell 16, the portions outwardly support the expanded shell and thereby increase the collapse resistance of the shell. This is one significant benefit of the system 10. Another significant benefit is that the interior portions 22, 24, 26 do not have to be expanded or otherwise formed in the well.

Instead, the portions 22, 24, 26 remain in their original fabricated configurations, thereby enabling flow passages 32, 34, 36 therein to retain their original smooth cylindrical shapes. This is of significant benefit in permitting full bore access through the interior portions 22, 24, 26, and in permitting successful setting and sealing engagement with other equipment, such as plugs, liner hangers, etc.

As depicted in FIG. 2, the tubular string 12 is cemented in the wellbore 14 after the shell 16 is expanded. The shell 16 could, however, be expanded before or after cement is flowed into the wellbore 14 about the tubular string 12. In addition, the interior portions 22, 24, 26 could be conveyed into the shell 16 before or after the shell is cemented within the cavity 20.

The passages 32, 34 in the interior portions 22, 24 are wellbore exit passages. Branch wellbores 38, 40 may be drilled by passing cutting tools, such as mills, drills, etc. through the passages 32, 34. However, note that the wellbores 38, 40 could already have been drilled when the wellbore junction 18 is assembled in the well, in which case the passages 32, 34 could be aligned with the existing wellbores, rather than drilling the wellbores through the passages.

The passage 36 in the interior portion 26 is inline with the passage 28 in the tubular string 12, thereby providing access and flow between the tubular string above and below the wellbore junction 18. Although the passage 36 is depicted as being somewhat smaller than the passage 28, it could be enlarged so that it is as large as, or larger than, the passage 28. Similarly, the passages 32, 34, which are laterally offset relative to the passage 28, could be as large as, or larger than, the passage 28.

The interior portions 22, 24, 26 could be sealed to each other when they are assembled within the expanded shell 16. For example, the portions 22, 24, 26 could carry seals thereon, or could form metal-to-metal seals due to contact with each other, or a sealant (such as an epoxy, polymer, composite material, etc.) could be flowed between the portions after they are positioned in the shell 16, etc.

Furthermore, the interior portions 22, 24, 26 could be sealed to the shell 16 in the same, or a different, manner. Injection of a material, such as a sealant, adhesive, bonding agent, cement, epoxy, composite material, other hardenable material, rubber, polymer, plastic, gel, foam, granular material, metal, etc., into gaps between the interior portions 22, 24, 26 and/or between the interior portions and the shell 16 could be used to increase the burst and/or collapse resistance of the junction apparatus 18.

Figure 3:
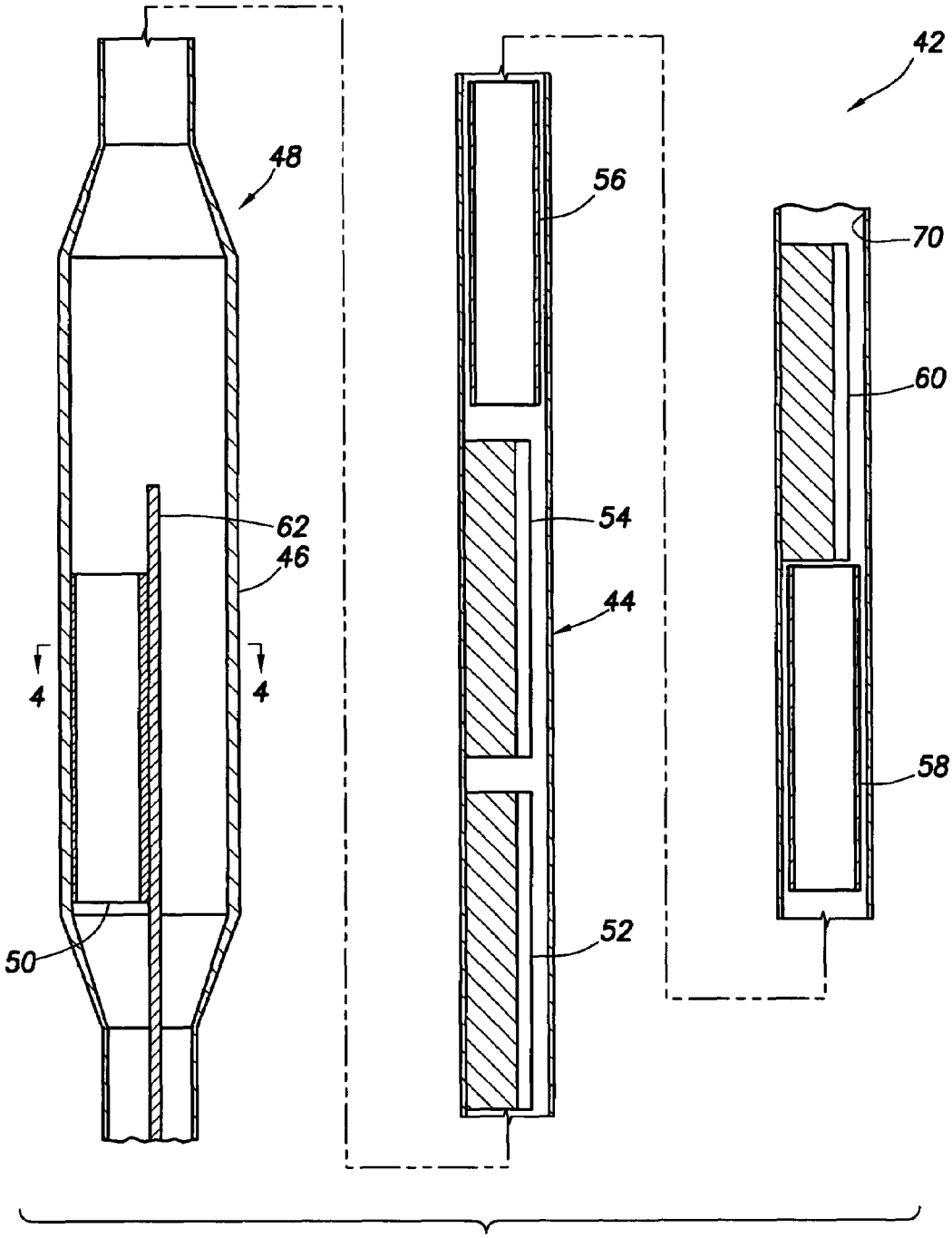
FIG. 3 is a schematic cross-sectional view of a second system and method embodying principles of the invention, in which initial steps of the method have been performed.
Figure 4:
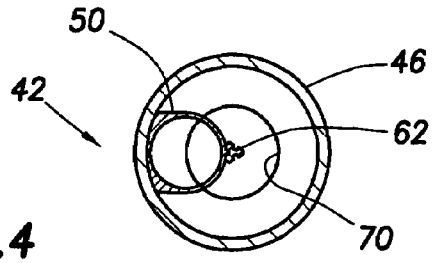
FIG. 4 is a cross-sectional view of the second system taken along line 4-4 of FIG. 3.

Referring additionally now to FIG. 3, another system 42 is representatively illustrated. The system 42 is shown apart from a well and wellbore in which a tubular string 44 is positioned with an expandable shell 46 interconnected therein. The shell 46 is depicted after having been expanded in the well.

The shell 46 is part of a wellbore junction apparatus 48, which also includes interior portions 50, 52, 54, 56, 58, 60. The interior portion 50 has been positioned within the expanded shell 46. A cross-sectional view is provided in FIG. 5, wherein it may be seen that the interior portion 50 is engaged with a central mandrel 62 in the shell 46. The mandrel 62 is used to appropriately guide and position the interior portions 50, 52, 54, 56, 58, 60 in the shell 46.

Figure 5:
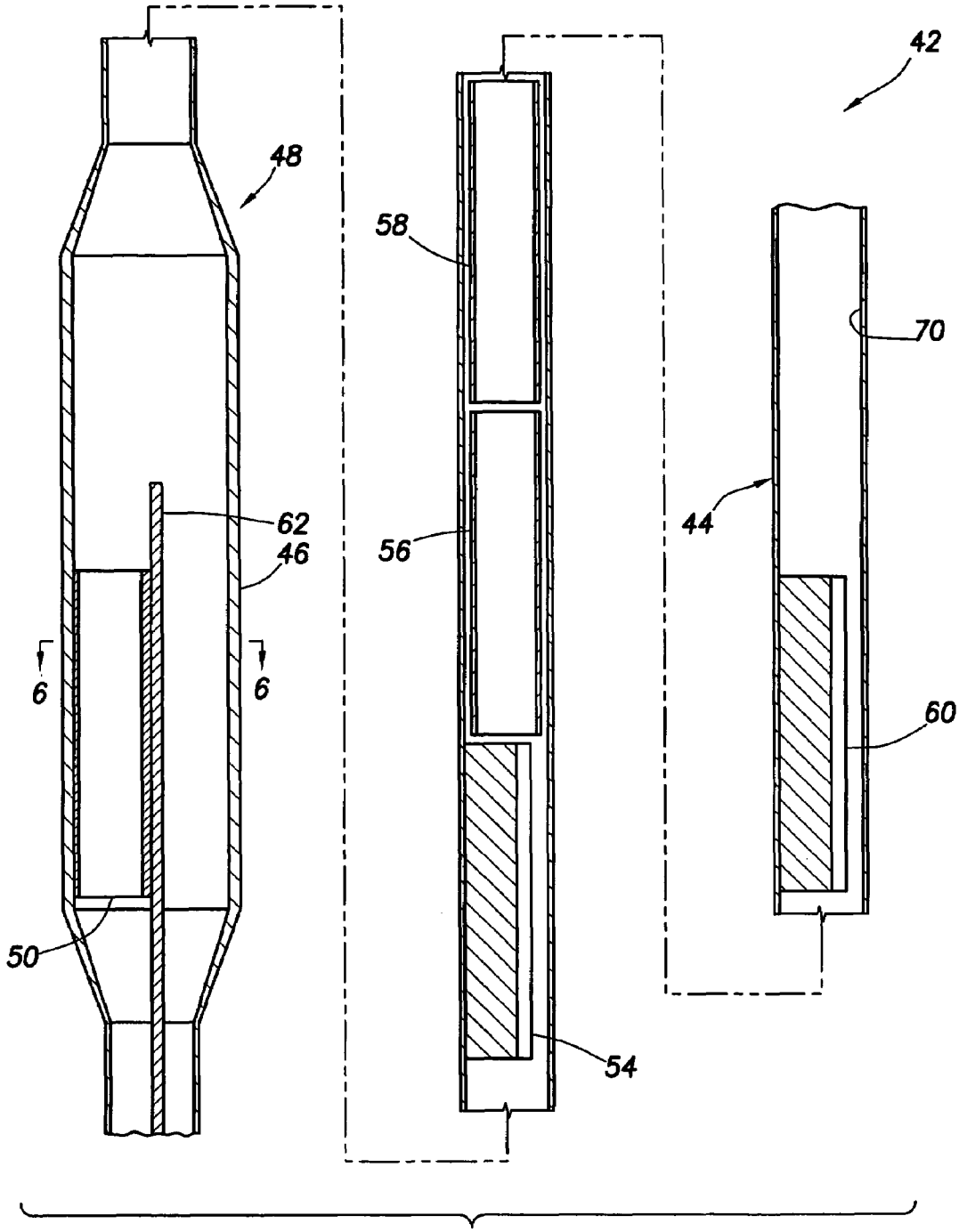
FIG. 5 is a schematic cross-sectional view of the second system and method, in which further steps of the method have been performed.
Figure 6:
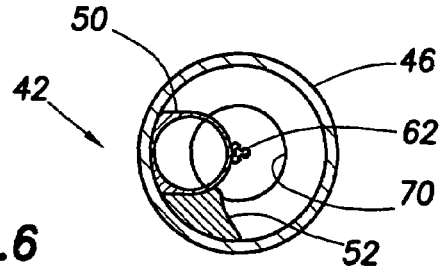
FIG. 6 is a cross-sectional view of the second system taken along line 6-6 of FIG. 5.

Referring additionally now to FIG. 5, the system 42 is shown after another interior portion 52 has been positioned in the expanded shell 46. A cross-sectional view is provided in FIG. 6. The interior portion 52 could be considered a spacer for appropriately spacing apart other interior portions. The interior portion 52 does not directly engage the mandrel 62.

Figure 7:
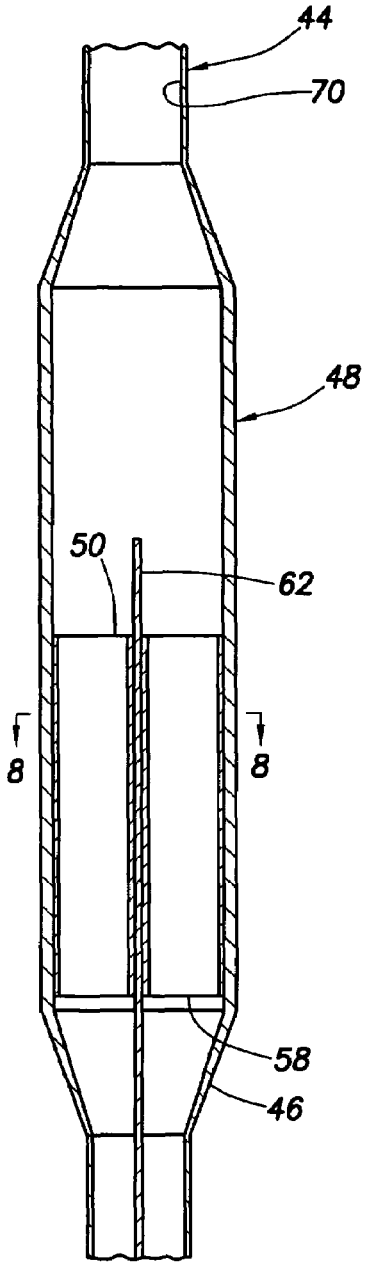
FIG. 7 is a schematic cross-sectional view of the second system and method, in which still further steps of the method have been performed.
Figure 8:
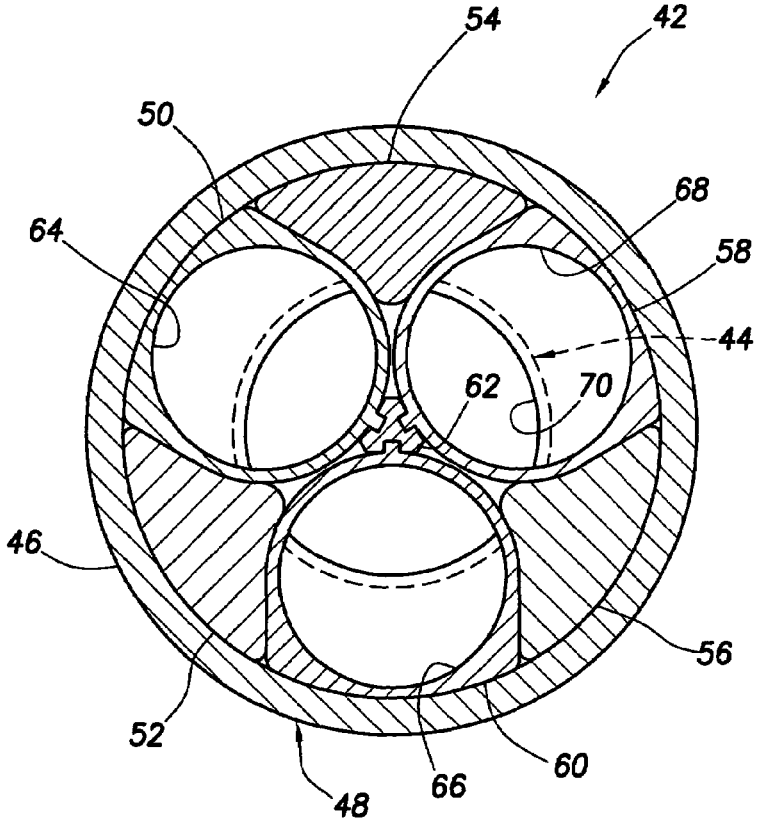
FIG. 8 is an enlarged scale cross-sectional view of the second system, taken along line 8-8 of FIG. 7.

Referring additionally now to FIG. 7, the system 42 is shown after all of the interior portions 50, 52, 54, 56, 58, 60 have been positioned in the expanded shell 46. The interior portions 50, 52, 54, 56, 58, 60 are circumferentially distributed within the expanded shell 46. The interior portions 50, 58, 60 are engaged with the mandrel 62, and are circumferentially spaced apart by the other interior portions 52, 54, 56.

The interior portions 50, 58, 60 have respective passages 64, 66, 68 formed therein, which are laterally offset relative to a longitudinal flow passage 70 of the tubular string 44. The passages 64, 66, 68 may be wellbore exit passages for drilling and/or communicating with branch wellbores, in the manner described above for the wellbore exit passages 32, 34 in the system 10.

As in the system 10, the interior portions 50, 52, 54, 56, 58, 60 outwardly support the expanded shell 46 and provide smooth cylindrical surfaces (passages 64, 66, 68) for access to branch wellbores, sealing engagement, etc. In the system 10, two such passages 32, 34 are provided, whereas in the system 42, three such passages 64, 66, 68 are provided. It should be understood that any number of wellbore exits, or other types of passages, may be provided in keeping with the principles of the invention. The interior portions 50, 52, 54, 56, 58, 60 may be sealed to each other and/or to the shell 46, as described above for the system 10.

Figure 9:
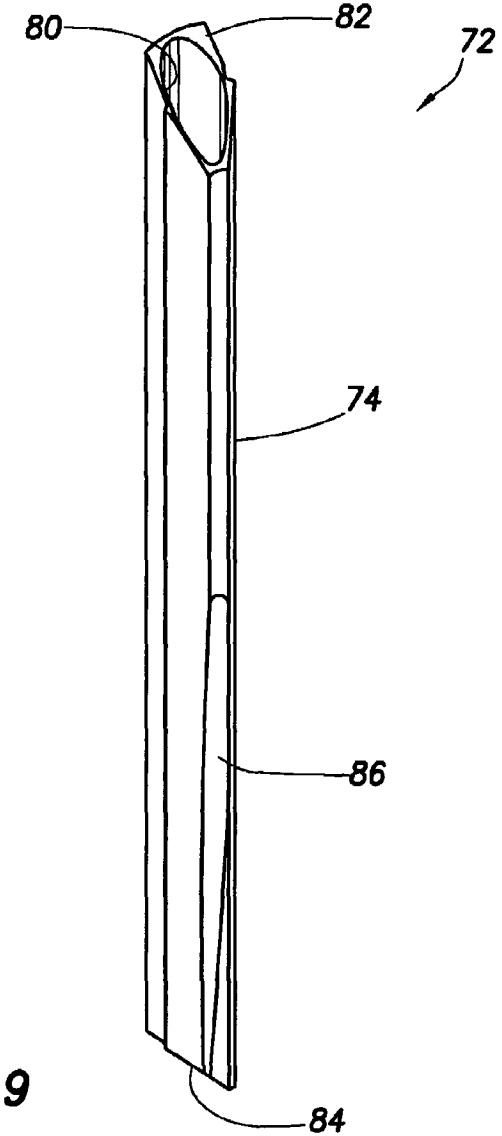
FIG. 9 is an isometric view of a portion of an apparatus in a third system and method embodying principles of the invention.

Referring additionally now to FIG. 9, another system 72 is representatively illustrated. The system includes multiple interior portions 74 (one of which is depicted in FIG. 9) which are specially configured for cooperative engagement with each other, and with a mandrel 78, to appropriately position each successive interior portion in an expanded shell 76.

As depicted in FIG. 9, the interior portion 74 includes a passage 80, an upper laterally inclined face 82, a lower laterally inclined face 84 and a side laterally inclined surface 86. The surface 86 is rounded or concave to match an outer profile of the mandrel 78, which is depicted as being cylindrical in shape. However, any shapes could be used for the surface 86 and the mandrel 78 in keeping with the principles of the invention.

Figure 10:
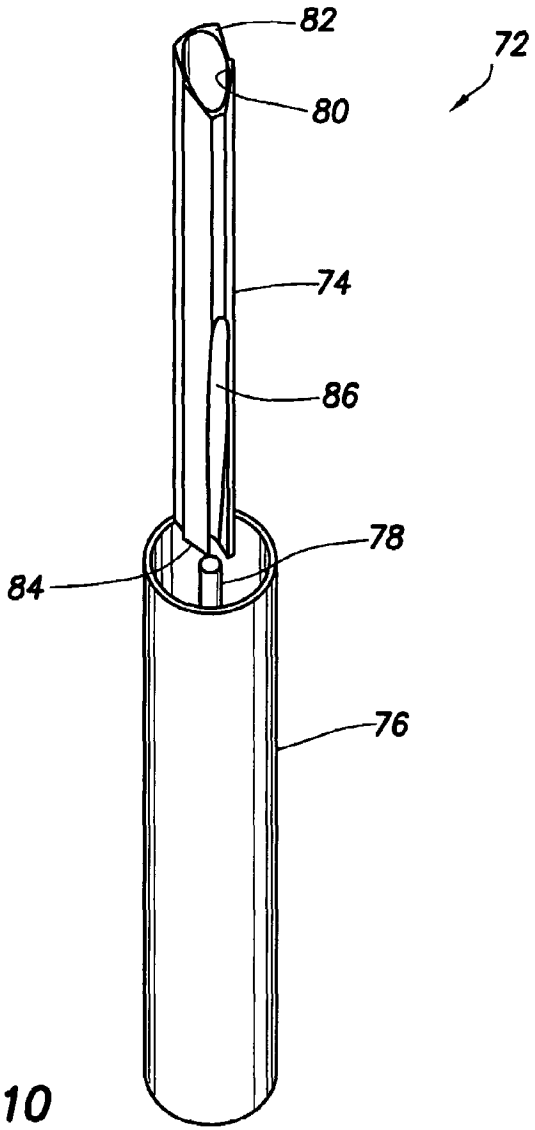
FIG. 10 is an isometric view of the apparatus portion being conveyed into an expanded shell in the third system and method.

Referring additionally now to FIG. 10, the interior portion 74 is shown as it is being inserted into the expanded shell 76. In practice, the interior portion 74 would be centered relative to the expanded shell 76 due to it being conveyed through a passage of a tubular string connected above the shell. The lower end of the surface 86 is thereby aligned with the mandrel 78, so that the mandrel engages the surface as the interior portion 74 is conveyed into the shell 76.

Figure 12:
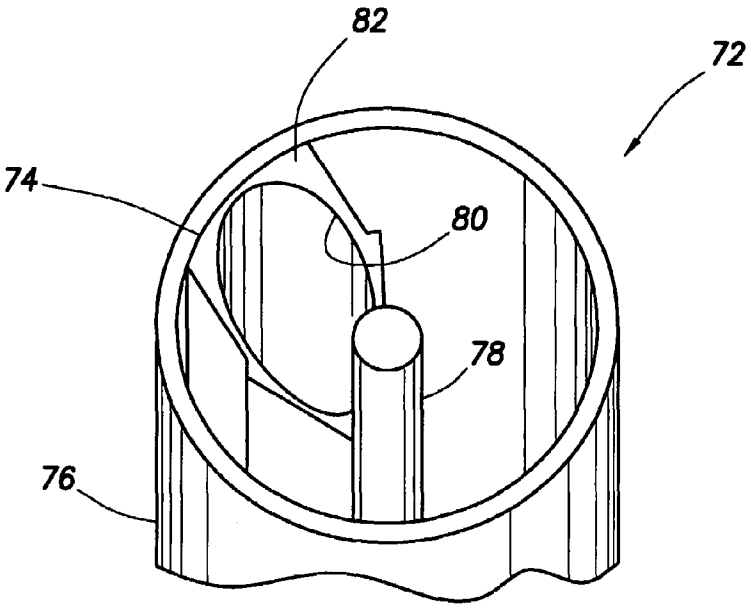
FIG. 12 is an enlarged scale isometric view of the apparatus portion positioned within the expanded shell in the third system and method.
Figure 11:
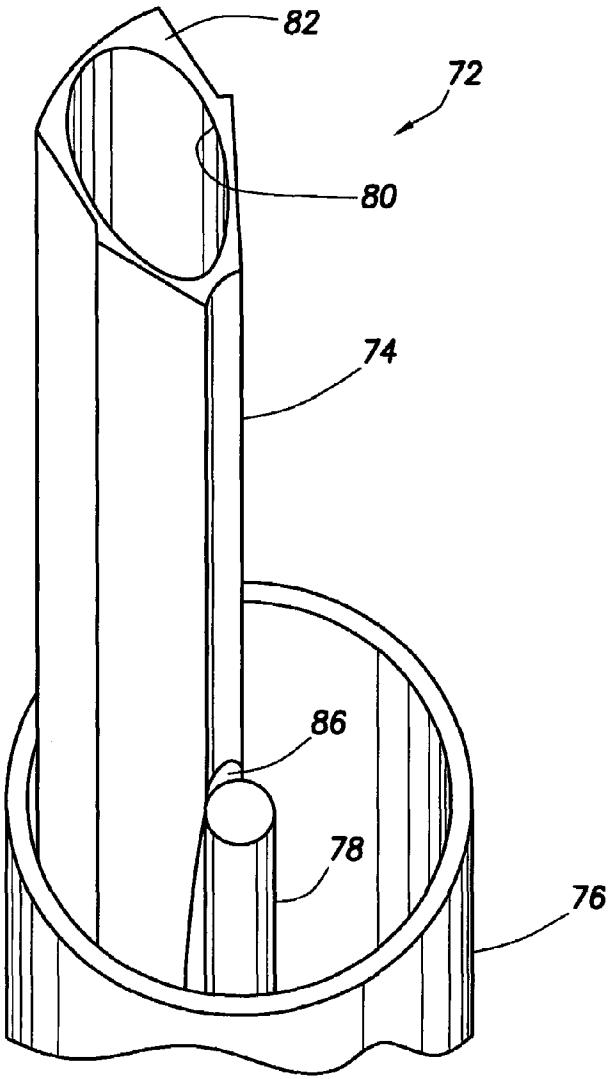
FIG. 11 is an enlarged scale isometric view of the apparatus portion being guided into position in the expanded shell in the third system and method.

Referring additionally now to FIG. 11, the system 72 is depicted in an enlarged scale view, in which the manner in which engagement between the surface 86 and the mandrel 78 operates to laterally deflect the interior portion 74 in the shell 76. In this manner, the interior portion 74 is appropriately positioned to one side of the mandrel 78. In FIG. 12, the interior portion 74 is shown completely installed in the shell 76.

Figure 13:
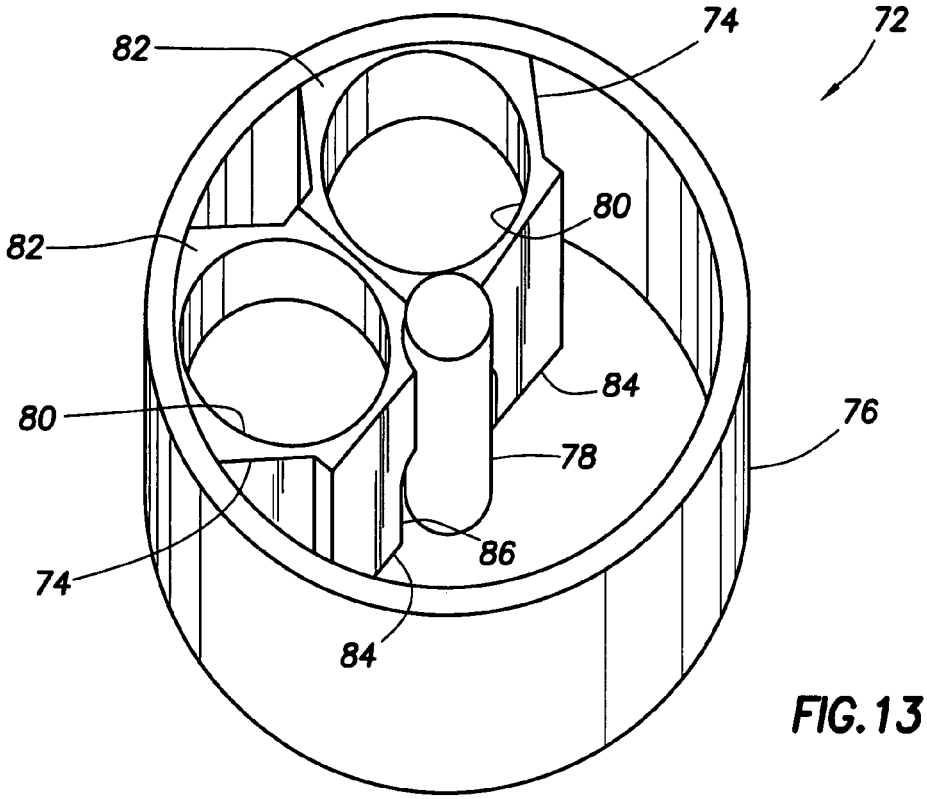
FIG. 13 is an enlarged scale isometric view of a second apparatus portion positioned within the expanded shell in the third system and method.

Referring additionally now to FIG. 13, the system 72 is representatively illustrated after another of the interior portions 74 is positioned in the shell 76. When the second interior portion 74 is conveyed into the shell, its side surface 86 engages the mandrel 78 as described above for the first interior portion, thereby laterally deflecting the second interior portion.

In addition, the lower inclined face 84 of the second interior portion 74 engages the upper inclined face 82 of the first interior portion if necessary to circumferentially position the second interior portion next to the first interior portion. It is not necessary at this point for the first and second interior portions 74 to be in direct contact with each other, but in this embodiment the interior portions are configured so that, once all of the interior portions have been installed, contact between the interior portions will operate to circumferentially position each of the interior portions.

Figure 14:
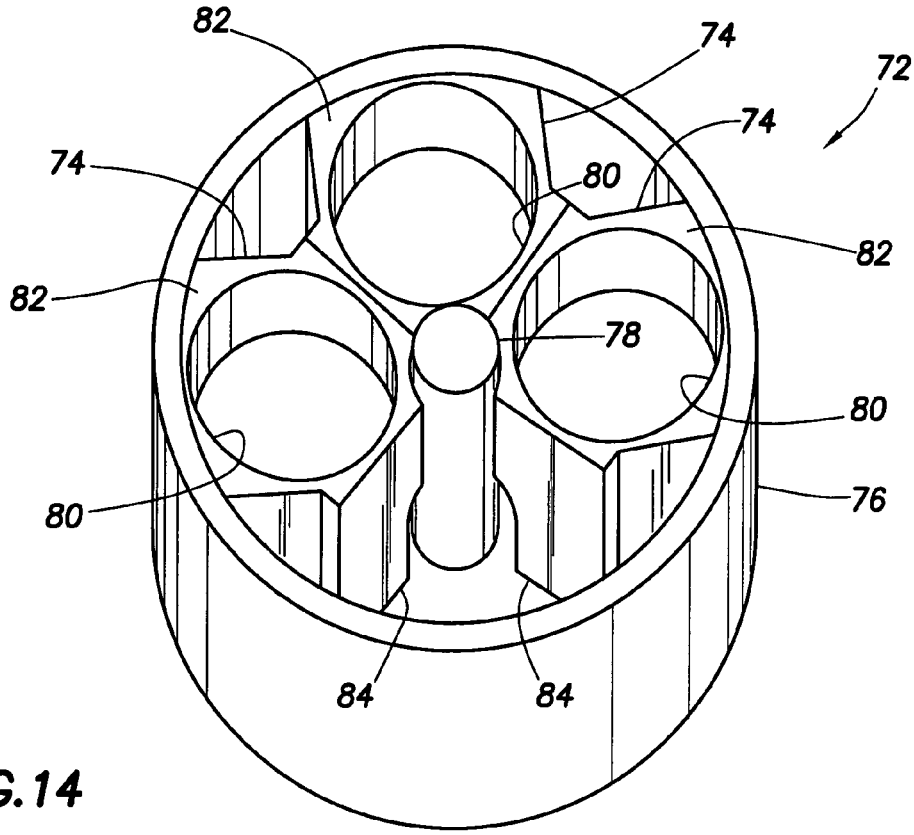
FIG. 14 is an enlarged scale isometric view of a third apparatus portion positioned within the expanded shell in the third system and method.

Referring additionally now to FIG. 14, the system 72 is representatively illustrated after a third interior portion 74 has been installed in the shell 76. As described above for the second interior portion 74, when the third interior portion is conveyed into the shell 76 the mandrel 78 engages its side surface 86, thereby laterally deflecting the interior portion. The lower inclined face 84 of the third interior portion 74 engages the upper inclined face 82 of the first or second interior portion if necessary, so that the third interior portion is positioned next to the first and second interior portions.

Figure 15:
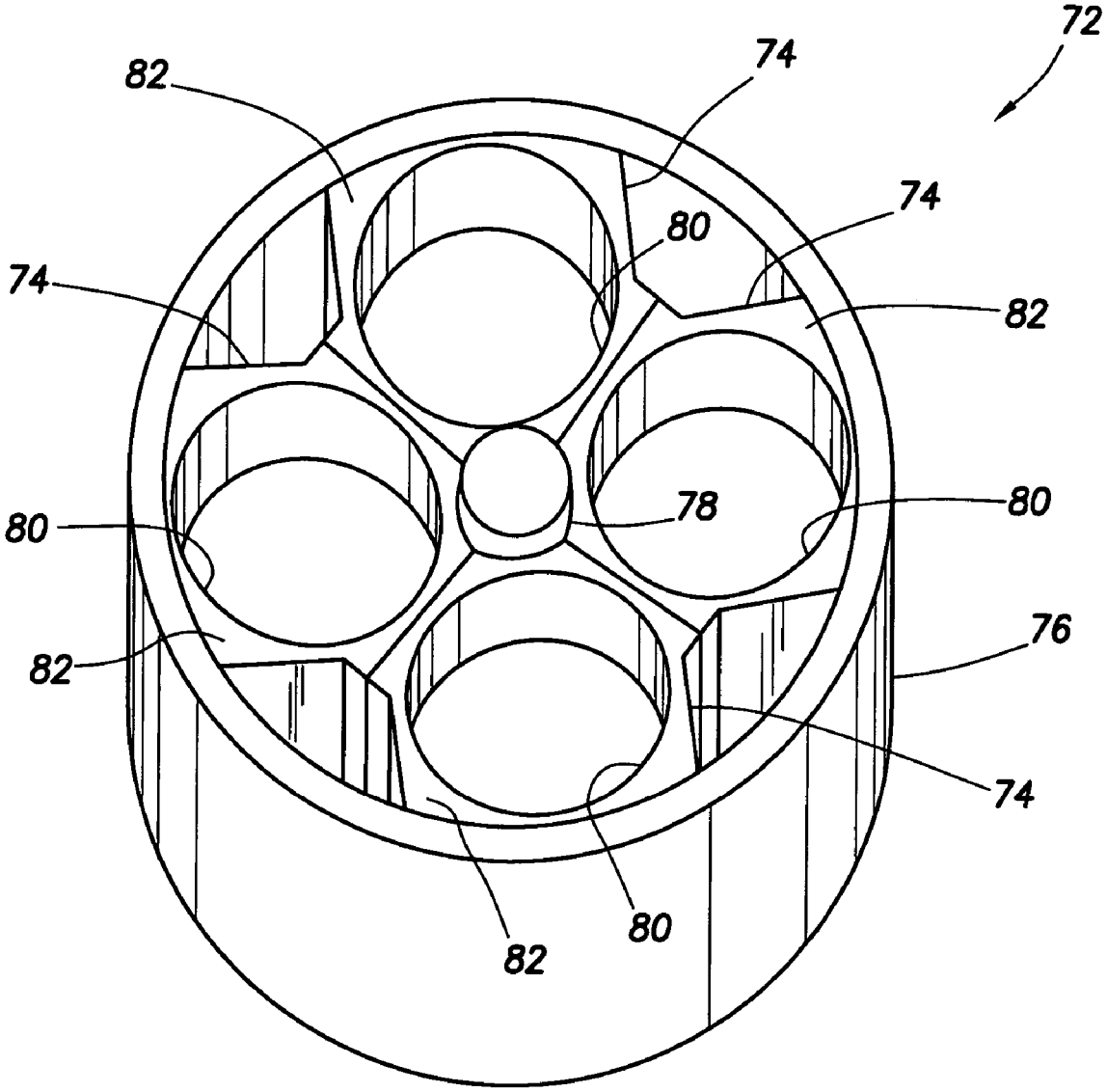
FIG. 15 is an enlarged scale isometric view of a fourth apparatus portion positioned within the expanded shell in the third system and method.

Referring additionally to FIG. 15, the system 72 is representatively illustrated after a fourth interior portion 74 has been installed in the shell 76. The fourth interior portion 74 is installed in the same manner as the other three, except that the fourth interior portion takes up the remaining circumferential space, so that the interior portions are now contacting each other, forming a stable interior assembly which outwardly supports the shell 76. Of course, some circumferential space between the interior portions 74 could remain, if desired.

As in the systems 10, 37, the interior portions 74 outwardly support the expanded shell 76 and provide smooth cylindrical surfaces (passages 80) for access to branch wellbores, sealing engagement, etc. In the system 72, four such passages 80 are provided, but it should be understood that any number of wellbore exits, or other types of passages, may be provided in keeping with the principles of the invention. The interior portions 74 may be sealed to each other and/or to the shell 76, as described above for the systems 10, 37.

The passages 80 may be wellbore exit passages, in which case branch wellbores may be drilled and/or communicated with via the passages, as in the systems 10, 37 described above. However, it should be understood that the principles of the invention are not limited to applications in which wellbore junctions are formed. Instead, any type of apparatus may be constructed downhole using the concepts described herein.

For example, the various passages could be used for long term downhole battery storage, treatment chemicals storage and/or dispensing, oil/water separation, etc. The assembled apparatus could be used for downhole power generation, pumping, intelligent completions, as a downhole factory, or for any other purpose in keeping with the principles of the invention, whether or not the apparatus has passages of the type described above. Therefore, it will be appreciated that a wellbore junction is only one example of a wide variety of types of apparatuses which may be assembled downhole using the principles of the invention.

Figure 16:
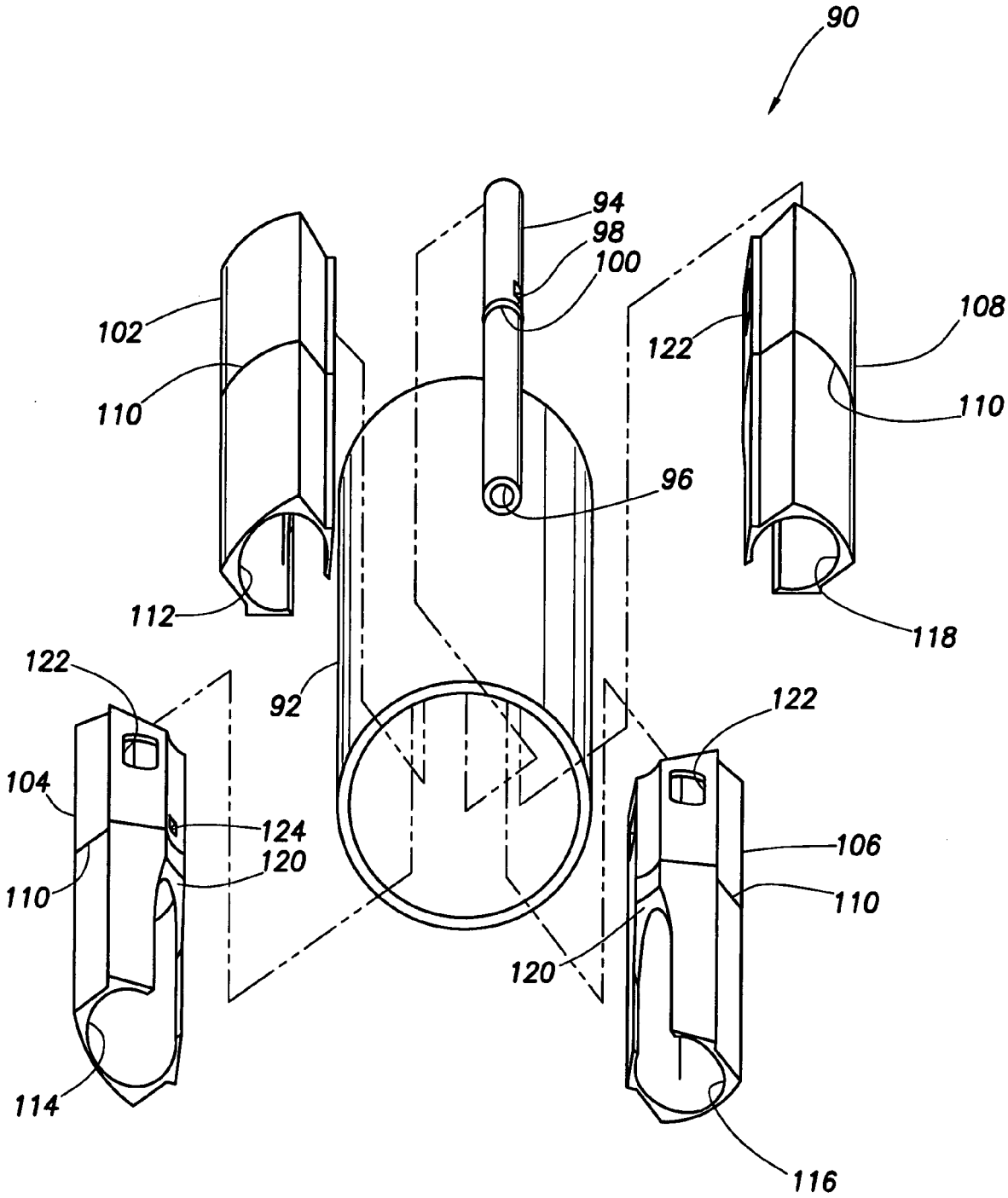
FIG. 16 is an exploded isometric view of a fourth system for assembling an apparatus embodying principles of the invention.

Referring additionally now to FIG. 16, another system 90 for assembling equipment in a well is representatively illustrated. The system 90 is depicted apart from a well and wellbore in which it may be used. However, the system 90 could be used in any type of wellbore, such as the wellbore 14 described above.

The system 90 includes an expandable shell 92, which is shown in FIG. 16 in its expanded configuration. Any method, such as inflating, mechanical swaging, etc., may be used to expand the shell 92. Although the shell 92 is generally tubular shaped as illustrated in FIG. 16, any shape may be used for a shell in keeping with the principles of the invention.

A mandrel 94 is positioned centrally within the expanded shell 92. The mandrel 94 may be positioned in the shell 92 before or after the shell is expanded. Note that the mandrel 94 differs somewhat from the other mandrels 62, 78 described above, at least in part in that the mandrel 94 is generally tubular shaped, having an interior longitudinally extending passage 96.

In addition, an opening 98 formed through a sidewall of the mandrel 94 provides communication (e.g., hydraulic, electrical, optical pneumatic, mechanical, data, etc. communication) between the interior and exterior of the mandrel. A seal 100 may be carried on the mandrel 94 for sealing engagement with one or more of multiple interior portions 102, 104, 106, 108. Each of the interior portions 102, 104, 106, 108 may also carry a seal 110 thereon for sealing engagement with each other, with the shell 92 and/or with the mandrel 94.

Each of the interior portions 102, 104, 106, 108 has an interior longitudinal passage 112, 114, 116, 118 formed therethrough. In this embodiment, the passages 112, 114, 116, 118 are wellbore exit passages, but it should be clearly understood that other types of passages, chambers, etc. could be formed in the interior portions 102, 104, 106, 108 in keeping with the principles of the invention.

Laterally inclined surfaces 120 formed on the interior portions 102, 104, 106, 108 aid in properly positioning the interior portions in the shell 92 after it has been expanded downhole. The surfaces 120 engage the mandrel 94, which laterally deflects the interior portions 102, 104, 106, 108 in the shell 92.

When properly positioned in the shell 92, the interior portions 102, 104, 106, 108 are circumferentially distributed between the mandrel 94 and the shell. Preferably, the interior portions 102, 104, 106, 108 contact each other, so that there is no (or only very little) circumferential space therebetween when the interior portions are positioned in the shell 92.

Each of the interior portions 102, 104, 106, 108 may have openings 122 formed through a sidewall thereof, in order to permit communication (e.g., hydraulic, electrical, optical pneumatic, mechanical, data, etc. communication) between an interior and exterior thereof. The openings 122 in the interior portions 102, 104, 106, 108 are aligned with adjacent openings to permit communication therebetween when the interior portions are installed in the shell 92. Specifically, the openings 122 permit communication between the passages 112, 114, 116, 118 in the various interior portions 102, 104, 106, 108. For example, the opening 122 visible in the interior portion 104 as depicted in FIG. 16 can permit fluid communication between the passage 114 in the interior portion 104 and the passage 112 in the interior portion 102 (when the opening 122 in the interior portion 104 is aligned with a similar opening 122 in the interior portion 102).

Similarly, each of the interior portions 102, 104, 106, 108 may have an opening 124 formed through a sidewall thereof to permit communication (e.g., hydraulic, electrical, optical pneumatic, mechanical, data, etc. communication) with the passage 96 in the mandrel 94 via the opening 98. The openings 124, 98 are aligned when the interior portions 102, 104, 106, 108 are installed in the shell 92. Thus, each of the passages 112, 114, 116, 118 in the interior portions 102, 104, 106, 108 may be placed in communication with one or more of each other, and one or more of the passages 112, 114, 116, 118 may be placed in communication with the passage 96 in the mandrel 94.

This communication between the passages 96, 112, 114, 116, 118 may be used for flow of fluids, for sensing parameters between passages, for conveying electrical wires or optical conductors (such as optical fibers), for transmitting pressure, for transmitting mechanical force, for transmitting magnetic force for transmitting thermal energy, for displacing equipment or structures between the passages, or for any other purpose or combination of purposes.

Figure 17:
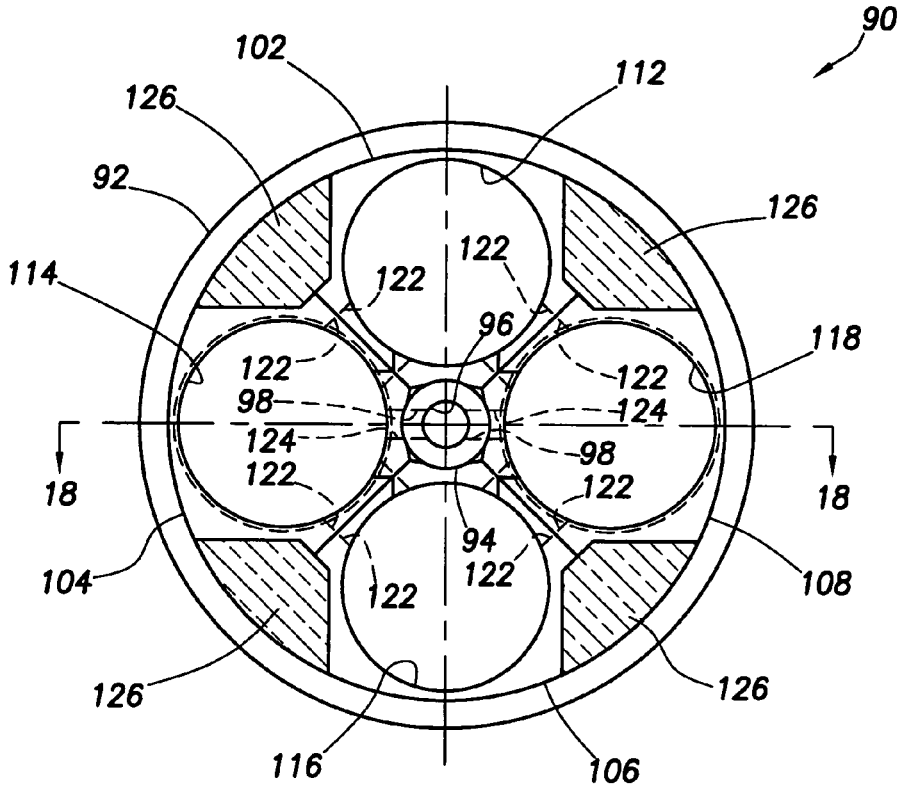
FIG. 17 is a bottom end view of the fourth system.

Referring additionally now to FIG. 17, a bottom end view of the system 90 is illustrated, with the interior portions 102, 104, 106, 108 installed in the shell 92. In this view, the manner in which the aligned openings 122 provide communication between the passages 112, 114, 116, 118 may be clearly seen. Also, the manner in which the aligned openings 98, 124 provide communication between the passage 96 in the mandrel 94 and the passages 114, 118 in the interior portions 104, 108 may be seen.

Note that more or fewer openings 98, 122, 124 may be used to provide communication between other combinations of the passages 96, 112, 114, 116, 118. For example, it is not necessary for all of the passages 112, 114, 116, 118 to be in communication with each other, and passages other than the passages 114, 118 may be in communication with the passage 96.

After the interior portions 102, 104, 106, 108 are installed in the shell 92, it will be readily appreciated that the interior portions outwardly support the shell against collapse. Further support may be obtained by filling in any voids between the interior portions 102, 104, 106, 108 and the shell 92 or the mandrel 94 with a hardenable material 126. The material 126 may also form a seal between the interior portions 102, 104, 106, 108, between the interior portions and the shell 92, and/or between the interior portions and the mandrel 94, in combination with, or in substitution for, the seals 100, 110.

The material 126 could be a cementitious material which will support a compressive load. Other materials, such as epoxies, may be used for the material 126 which will support a compressive load, support a tensile load (to increase burst resistance of the shell 92, although primary burst resistance would preferably be due to the walls of the interior portions) and seal between the interior portions 102, 104, 106, 108, the shell and the mandrel 94. Examples of other materials which may be used for the material 126 include rubber compounds, other polymers and plastics, gels, hardenable foams, granular materials (such as sand), metals, etc.

Figure 18:
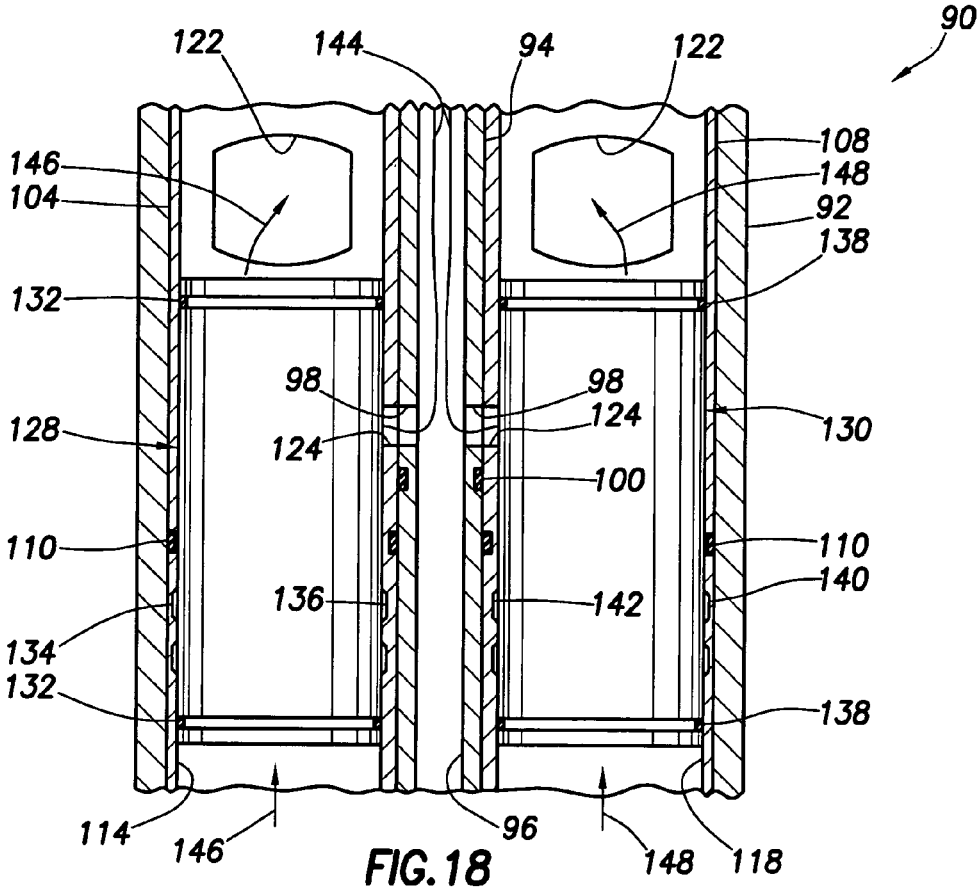
FIG. 18 is a cross-sectional view of the fourth system, taken along line 18-18 of FIG. 17.

Referring additionally now to FIG. 18, an example of an application for the system 90 is illustrated. In this application, well tools 128, 130 are sealingly secured within the respective passages 114, 118 of the interior portions 104, 108. Seals 132 carried on the well tool 128 straddle the opening 124 in the interior portion 104, and latch keys or dogs 134 engage a profile 136 formed in the passage 114.

Similarly, seals 138 carried on the well tool 130 straddle the opening 124 in the interior portion 108, and latch keys or dogs 140 engage a profile 142 formed in the passage 118. Of course, other means of sealing and securing the well tools 128, 130 in the interior portions 104, 108 (such as packer slips and extruding or outwardly extending seal elements, etc.) may be used if desired.

The well tools 128, 130 in this example are pumps, which are supplied with electrical power via conductors or wires 144 extending through the passage 96 in the mandrel 94 and through the aligned openings 98, 124 to the well tools. However, it should be clearly understood that any type of well tool could be used for the well tools 128, 130. For example, the well tools 128, 130 (or either of them) could be a steam generator, a flow control device (such as a valve or choke), a sensor (such as a pressure, differential pressure, temperature, water cut, resistivity, capacitance, pH, radioactivity, position, flow rate, density, velocity, multiphase flowmeter, flow, density, oil/water ratio, acceleration, seismic, thermal, wireless electromagnetic, magnetic, acoustic, multiphase, mechanical (e.g., position) or other type of sensor), a heater, a gas lift device, a chemical injection device, an oil/water separator and/or gas/oil separator, storage container, packer, plug, multiphase pump, multiphase separator, etc.

The tools 128, 130 pump respective fluids (indicated by arrows 146, 148) from the passages 114, 118 through the openings 122 to the passage 116 in the interior portion 106 for transport to the surface. For example, the passages 114, 118 below the well tools 128, 130 may be in communication with multiple wellbores from which the fluids 146, 148 are produced, and the passage 116 may be in communication with a production tubing string extending to the surface.

The well tools 128, 130 can each transmit and/or receive various types of signals to/from each other or other well tools or any other portions of the apparatus 88. The well tools 128, 130 can be in communication (e.g., hydraulic, electrical, optical, pneumatic, mechanical, data, etc. communication) with each other, other well tools or any other portions of the apparatus 88. The well tools 128, 130 can be axially and/or rotationally aligned with intake, outflow, communication and power ports in the interior portions 102, 104, 106, 108.

Figure 19:
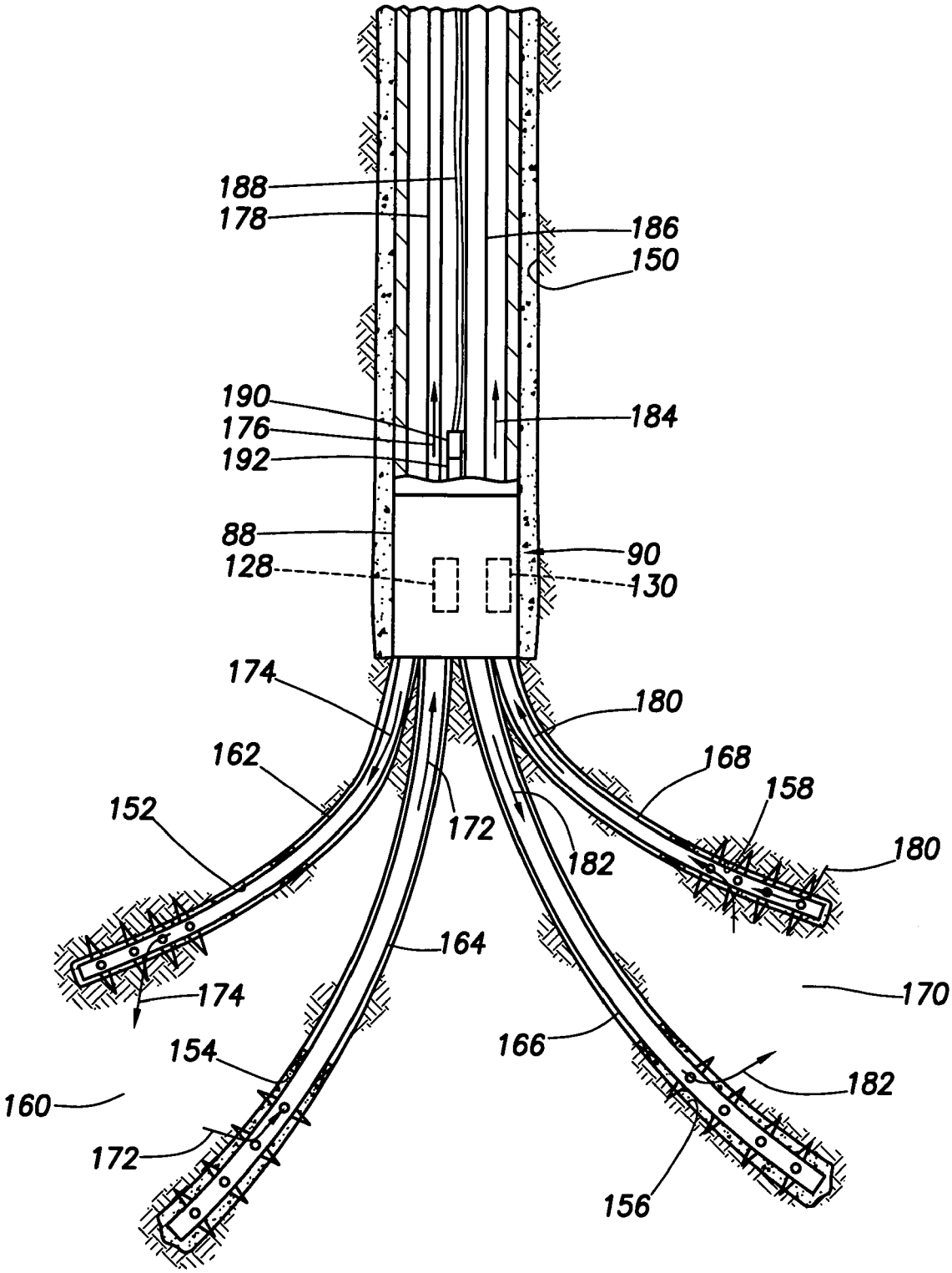
FIG. 19 is a schematic partially cross-sectional view of a fourth method of using the fourth system in a well, the method embodying principles of the invention.

As mentioned above, the well tools 128, 130 could be oil/water or oil/gas separators. In FIG. 19, the system 90 is schematically illustrated in another application in which the passages 112, 114, 116, 118 are placed in communication with respective wellbores 152, 154, 156, 158.

For example, the wellbores 152, 154, 156, 158 could be branch wellbores drilled outwardly from a main or parent wellbore 150 in which the system 90 is installed. The wellbores 152, 154, 156, 158 could be drilled through the passages 112, 114, 116, 118, or the wellbores could be drilled prior to installing the system 90, and then the passages aligned with the respective wellbores.

Thus, in this application, the system 90 comprises a wellbore junction apparatus 88 which includes the shell 92, mandrel 94 and interior portions 102, 104, 106, 108. The shell 92 may be expanded downhole prior to installing the interior portions 102, 104, 106, 108 in the shell. The mandrel 94 may be positioned in the shell 92 prior to, or after, the shell is expanded in the wellbore 150.

Tubular strings 162, 164, 166, 168, such as liner strings, are installed in the respective wellbores 152, 154, 156, 158 and are placed in communication with the respective passages 112, 114, 116, 118. For example, conventional liner hangers (not visible in FIG. 19) may be used to sealingly secure the upper ends of the strings 162, 164, 166, 168 in the respective passages 112, 114, 116, 118.

The wellbores 152, 154 intersect respective upper and lower portions of a formation 160. Fluid 172 is produced from the formation 160 and flows through the tubular string 164 to the system 90 where it enters the well tool 128 (an oil/gas separator) in the passage 114. The fluid 172 is a combination of oil and gas.

The well tool 128 separates the gas 174 from the oil 176. The gas 174 may be flowed from the passage 114 to the passage 112 (via openings 122 between the interior portions 102, 104) where it enters the tubular string 162 and flows back into the formation 160.

This helps to drive more of the fluid 172 to the wellbore 154, stores the gas 174 in the formation 160 and prevents possibly wasteful and/or hazardous production of the gas to the surface. The oil 176 is flowed to the surface via a tubular string 178 (such as a production tubing string) sealingly secured in the passage 114 above the well tool 128.

The wellbores 158, 156 intersect respective upper and lower portions of a formation 170. Fluid 180 is produced from the formation 170 and flows through the tubular string 168 to the system 90 where it enters the well tool 130 (an oil/water separator) in the passage 118. The fluid 180 is a combination of oil and water.

The well tool 130 separates the water 182 from the oil 184. The water 182 may be flowed from the passage 118 to the passage 116 (via openings 122 between the interior portions 106, 108) where it enters the tubular string 166 and flows or is pumped back into the formation 170. This helps to drive more of the fluid 180 to the wellbore 158 and prevents possibly environmentally harmful production of the water to the surface, eliminates expensive surface equipment and processes (e.g., separation equipment, heaters, storage tanks, injection/disposal pumps, lines and wells, etc.). This is especially important for offshore wells/platforms where space is at a premium. The water 182 and gas 174 may alternatively be disposed of/stored in/injected into formations other than the ones they were produced from. The oil 184 is flowed to the surface via a tubular string 186 (such as a production tubing string) sealingly secured in the passage 118 above the well tool 130.

Power to operate the well tools 128, 130 may be supplied via electrical conductors or wires (such as the wires 144 described above) positioned in a conductor, conduit or line 188 (such as conventional control line) attached to either of the tubular strings 178, 186. As depicted in FIG. 19, the line 188 is attached to the tubular string 186.

A "wet connect" electrical connector 190 at a lower end of the line 188 engages another such electrical connector 192 at an upper end of the mandrel 94 when the tubular string 186 is installed in the passage 118. In this manner, the electrical conductors in the line 188 are placed in electrical contact with the electrical conductors (such as the wires 144) in the mandrel 94. However, it is not essential for the line 188 to terminate at the wet connect electrical connector 190. For example, line 188 could be connected directly to the well tools 128, 130 prior to the tools being run into the well.

Instead of, or in addition to, electrical conductors, other types of lines or conductors which may be connected using the connectors 190, 192 include optical conductors (such as optical fibers), chemical injection lines, gas injection lines, hydraulic pressure lines, data transmission lines, command and control communication lines, pneumatic lines, mechanical lines (such as a rod which is used to shift a device in the mandrel 94), magnetic conductors, thermal conductors, etc. For example, the well tools 128, 130 could include oil/water and/or oil/gas ratio sensors which use optical fibers to transmit indications of the respective ratios. The connectors 190, 192 may also be mechanical connectors, for example, to secure the line 188 to the mandrel 94.

The connectors 190, 192 could include conventional "wet connect" optical connectors for connecting between optical fibers in the mandrel 94 and optical fibers in the line 188 attached to the tubular string 186. As another example, the well tool 130 could be a chemical injection pump, in which case the line 188 could be used to convey treatment chemicals to the well tool, and the connectors 190, 192 could include conventional hydraulic connectors.

Figure 20:
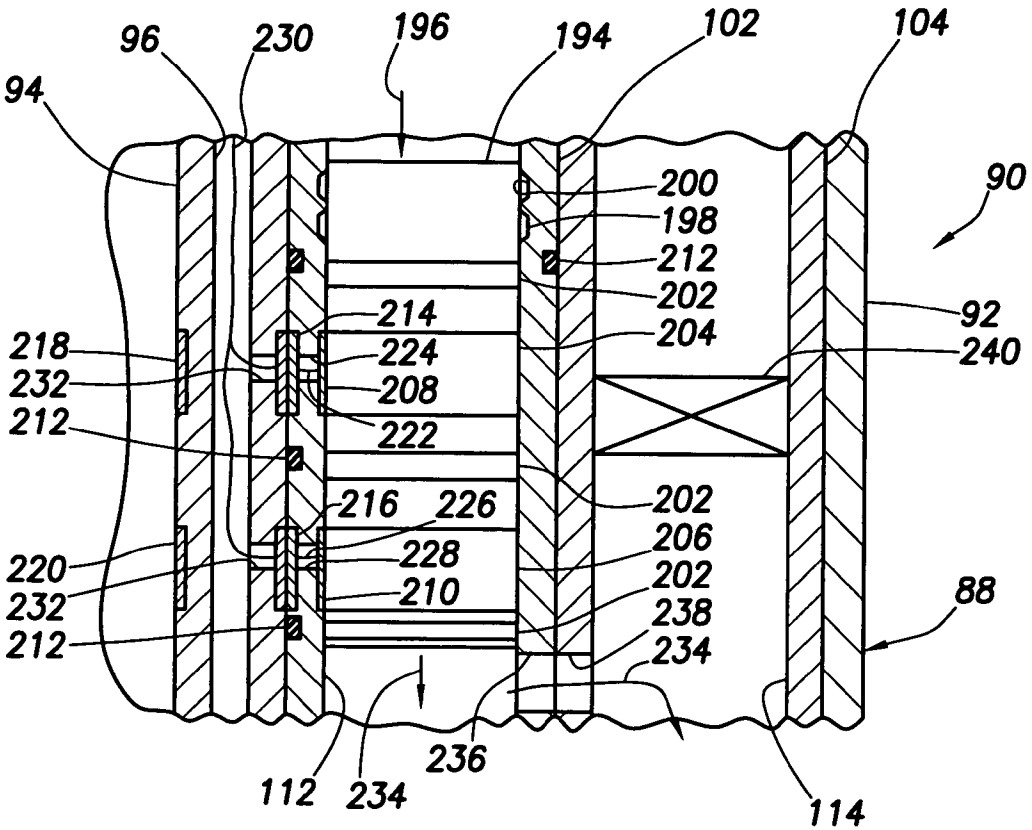
FIG. 20 is a schematic partially cross-sectional view of a fifth method of using the fourth system in a well, the method embodying principles of the invention.

Referring additionally now to FIG. 20, another application for the system 90 is schematically illustrated. In this application, a steam generator 194 is used to convert water 196 into steam and pump the steam into multiple wellbores below the junction apparatus 88.

The junction apparatus 88 could be installed in a wellbore, such as the wellbore 150 described above and depicted in FIG. 19. The outer shell 92 may be expanded and at least interior portions 102, 104 installed therein. The mandrel 94 may be installed in the shell 92 before or after it is expanded. The interior portions 106, 108 are not depicted in FIG. 20, but they could also be installed in the shell 92, if desired.

The interior portion 102 is depicted in FIG. 20 as being positioned laterally between the mandrel 94 and the interior portion 104 for clarity of description. Typically, it would be preferable to circumferentially distribute the interior portions 102, 104, 106, 108 about the mandrel 94 as described above. However, the application as shown in FIG. 20 demonstrates that the interior portions 102, 104, 106, 108 could be arranged otherwise in the shell 92 (such as laterally, radially, etc. distributed) in keeping with the principles of the invention.

The passage 112 in the interior portion 102 is in communication with one wellbore below the junction apparatus 88, and the passage 114 in the interior portion 104 is in communication with another wellbore below the junction apparatus. These wellbores could, for example, be branch wellbores drilled from a main wellbore in which the junction apparatus 88 is positioned. The branch wellbores could be drilled by passing tools, such as drill strings, through the passages 112, 114, or the branch wellbores could be drilled prior to installing the junction apparatus 88 in the main wellbore.

Of course, many other configurations are possible. For example, one of the passages 112, 114 could be in communication with the main wellbore below the junction apparatus while the other of the passages could be in communication with a branch wellbore, etc.

When the steam generator 194 is installed in the passage 112 it is secured, for example, with latch keys 198 engaging an internal profile 200. The steam generator 194 is also sealed in the passage 112 with seals 202 which longitudinally straddle electrical connectors 204, 206 (such as electrical contacts) on the steam generator. Note that it is not necessary for all of the seals 202 to form a pressure-tight seal in the passage 112, since one or more of the seals may be used as wipers to clean off surfaces of connectors 208, 210 (such as electrical contacts) in the interior portion 102 and to insulate between the connectors.

Thus, when the steam generator 194 is installed in the passage 112, the connectors 204, 206 carried on the steam generator make electrical contact with the corresponding connectors 208, 210 in the interior portion 102. In a similar manner, when the interior portion 102 is installed in the shell 92, seals 212 on the interior portion seal against the mandrel 94 and the other interior portion 104, and electrical connectors 214, 216 (such as electrical contacts) carried on the interior portion make electrical contact with corresponding connectors 218, 220 (such as electrical contacts) on the mandrel. One or more of the seals 212 may serve to wipe the connectors 218, 220 clean and/or provide electrical insulation between the sets of connectors 214, 216, 218, 220.

Note that the steam generator 194 could be installed in the interior portion 102 before or after the interior portion is installed in the shell 92. Thus, it may not be necessary for the steam generator 194 to be releasable from the interior portion 102, for the steam generator to be separately sealed to the interior portion, or for the separate electrical connectors 204, 206, 208, 210 to be provided. Instead, the steam generator 194 could be incorporated into the interior portion 102, so that it is installed as part of the interior portion. The steam generator 194 (or other well tool or device) could be releasably connected to the interior portion 102 so that they are run/installed together, but if the steam generator fails it can be released from the interior portion and replaced.

An electrical conductor or wire 222 connects the connectors 208, 214 through an opening 224 in a sidewall of the interior portion 102. Another electrical conductor or wire 226 connects the connectors 210, 216 through an opening 228 formed through the sidewall of the interior portion 102. Electrical conductors or wires 230 extend through the passage 96 in the mandrel 94 and connect to the connectors 214, 216 via openings 232 formed through the sidewall of the mandrel.

In this manner, the connectors 204, 206 on the steam generator 194 are electrically connected to the conductors 230 in the mandrel to, for example, supply electrical power to the steam generator, communicate with the steam generator (e.g., transmit commands to the steam generator, transmit indications from sensors in the steam generator, etc.), or for other purposes. The conductors 230 may be connected to a source of electrical power or a command/control system via the connectors 190, 192 as described above and illustrated in FIG. 19. If the upper connector 190 is attached to a tubular string (such as the tubular string 186 illustrated in FIG. 19), then the water 196 could be delivered to the passage 112 via the tubular string.

The water 196 is converted to steam 234 by the steam generator 194. The steam 234 flows downwardly through the passage 112 to the wellbore which is in communication with that passage. In addition, the steam 234 flows through aligned openings 236, 238 formed through the sidewalls of the respective interior portions 102, 104. The steam 234 flows downwardly through the passage 114 to the wellbore which is in communication with that passage.

A removable plug 240 is installed in the passage 114 to prevent the steam 234 from flowing upwardly through the passage. The plug 240 may be a conventional bridge plug (with slips and one or more compressible or outwardly extendable seal elements) or a plug of the type having latch keys and seals, and which may be conveyed and retrieved by wireline, coiled tubing, etc.

If access to either of the wellbores below the passages 112, 114 is desired, the steam generator 194 and/or plug 240 may be conveniently retrieved from the respective passage. In addition, the steam generator 194 can be conveniently retrieved for maintenance, repair or replacement.

Note that, rather than conducting electricity, the conductors 222, 226, 230 could be optical conductors, such as optical fibers. For example, the conductors 222, 226, 230 could be used to transmit/receive light between a remote location (such as the earth's surface or another location in the well) and optical sensors (such as Bragg gratings, interferometric sensors, etc.) in the steam generator 194, or to optically communicate data or commands (e.g., in digital or analog form) between the steam generator and the remote location.

In that case, the connectors 204, 206, 208, 210, 214, 216, 218, 220 would instead be optical connectors (such as conventional "wet connect" optical connectors). These connectors could also include mechanical connectors to secure one interior portion to another, to the mandrel, to the shell, to a well tool in the apparatus, etc. Thus, it will be appreciated that any type of conductors and connectors (e.g., electrical, optical, hydraulic, pneumatic, mechanical, magnetic, thermal, etc.), and any combination of conductor and connector types, may be used in the system 90 in keeping with the principles of the invention.

Figure 21:
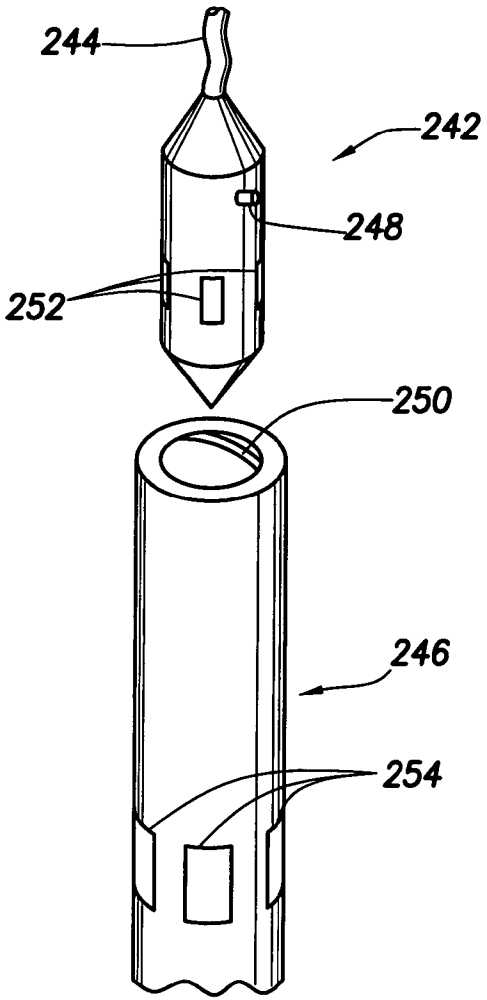
FIG. 21 is a schematic isometric view of a connection device which may be used in the fourth system.

Referring additionally now to FIG. 21, a method of connecting between a remote location and the system 90 is representatively illustrated. This method may be used to supply electrical power to the system 90 and/or make an optical, hydraulic, pneumatic, mechanical, magnetic or thermal connection between the system and the remote location, etc. The method is described below as if an electrical connection is made, but is should be understood that any type of connection may be made between the system 90 and the remote location in keeping with the principles of the invention.

A connector assembly 242 is conveyed into the well on a line 244. The line 244 may be a wireline, electric line, etc. and may include one or more electrical conductors. If an optical connection is to be made, the line 244 could include one or more optical conductors, such as optical fibers. If a hydraulic or pneumatic connection is to be made, the line 244 could include one or more hydraulic or pneumatic conductors, such as a control line or a coiled tubing string. Various combinations of lines can also be used, such as combined electrical and optical conductors, electrical and/or optical conductors within a hydraulic or pneumatic control line, etc.

The connector assembly 242 engages another connector assembly 246. Preferably, the connector assembly 246 is attached above the mandrel 94, so that the connector assembly extends upwardly from the mandrel. This is similar to the manner in which the connector 192 is attached to the mandrel 94 in the system 90 as illustrated in FIG. 19. The connectors 242, 246 may be used in place of the connectors 190, 192.

As the connector assemblies 242, 246 are engaged, an alignment member 248 (such as an outwardly extending lug) on the upper connector assembly engages an alignment profile 250 (such as a helically extending ramp or muleshoe) in the lower connector assembly. The engagement between the member 248 and the profile 250 rotationally aligns connectors 252 on the upper assembly 242 with connectors 254 on the lower assembly 246. The connectors 242, 246 can include mechanical connectors, such as a latch. The connectors 242, 246 can include thermal and/or magnetic connectors.

The connectors 254 may extend through a sidewall to an interior of the generally tubular lower assembly 246, where the connectors 254 can connect with the connectors 252. Alternatively, separate connectors (connectors 254 on an exterior of the lower assembly 246, and other connectors (not visible in FIG. 21) on an interior of the lower assembly) may be provided on each side of the lower assembly 246 sidewall with a conductor connecting the connectors, similar to the manner in which the connectors 208, 210, 214, 216 are connected by conductors 222, 226 in the embodiment depicted in FIG. 20.

If electrical connections are to be made between the connectors, they may be electrical contacts. If optical connections are to be made between the connectors, they may be optical connectors. If hydraulic or pneumatic connections are to be made between the connectors, they may be hydraulic or pneumatic connectors. They may be mechanical, thermal and/or magnetic connectors.

As depicted in FIG. 21, the connectors 252, 254 are circumferentially spaced apart. However, the connectors 252, 254 could be otherwise arranged. For example, the connectors 252, 254 could be longitudinally, helically or radially spaced apart, or any combination of these, with or without also being circumferentially spaced apart, etc.

The connectors 254 on the exterior of the lower assembly 246 may be used to make connections with the interior portions 102, 104, 106, 108 of the system 90. If the connectors 254 are circumferentially spaced apart on the lower assembly 246 and the interior portions 102, 104, 106, 108 are also circumferentially distributed about the mandrel 94, then one or more of the connectors may be used to make connections with each of the interior portions separate from the connections made with the other interior portions. Of course, separate connections between the connectors 254 and the interior portions 102, 104, 106, 108 may also be made if the connectors are radially, longitudinally, helically, etc. spaced apart, and/or if the interior portions are otherwise distributed in the shell 92.

Figure 22:
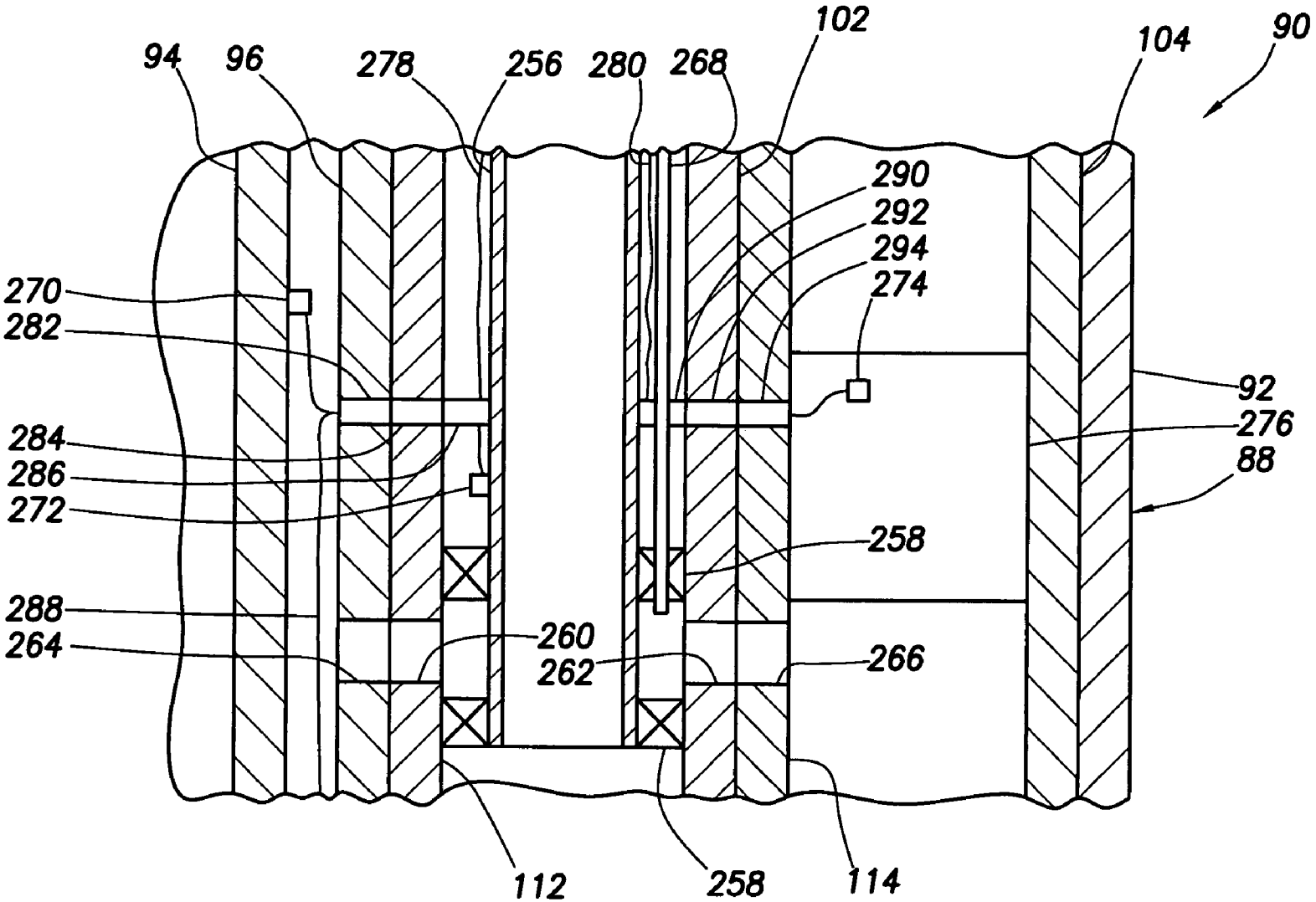
FIG. 22 is a schematic partially cross-sectional view of a sixth method of using the fourth system in a well, the method embodying principles of the invention.

Referring additionally now to FIG. 22, another application for use of the system 90 is representatively illustrated. In this application, connections between a remote location and the system 90 are made via one of the interior portions 102, 104, 106, 108 rather than via the mandrel 94. This demonstrates the remarkable versatility afforded by the principles of the invention in well operations.

As depicted in FIG. 22, a tubular string 256, such as a production tubing string, is received within the passage 112 in the interior portion 102. Seals 258 on the tubular string 256 longitudinally straddle openings 260, 262 formed through a sidewall of the interior portion 102. The opening 260 is aligned with an opening 264 formed through a sidewall of the mandrel 94, thereby providing fluid communication between the passage 96 in the mandrel and the passage 112 longitudinally between the seals 258 and radially between the tubular string 256 and the interior portion 102. The opening 262 is aligned with an opening 266 formed through a sidewall of the interior portion 104, thereby providing fluid communication between the passage 114 in the interior portion 104 and the passage 112 longitudinally between the seals 258 and radially between the tubular string 256 and the interior portion 102.

A hydraulic conductor 268, such as a control line, is attached to the tubular string 256 and provides fluid communication between the remote location and the passage 112 longitudinally between the seals 258 and radially between the tubular string 256 and the interior portion 102. Thus, the conductor 268 is also in fluid communication with the passage 114 in the interior portion 104, and with the passage 96 in the mandrel 94. The conductor 268 may be used for a variety of purposes, for example, to inject treatment chemicals into the passage 114, to sense pressure in the passage 114, for pressure communication with the passage 96 in a well control system, etc.

The system 90 as depicted in FIG. 22 also includes various sensors 270, 272, 274. The sensors 270, 272, 274 may be any type of sensors or combination of sensors, such as pressure, differential pressure, temperature, water cut, resistivity, capacitance, pH, radioactivity, position, flow rate, density, velocity, multiphase flowmeter, flow, density, oil/water ratio, acceleration, seismic, thermal, wireless electromagnetic, magnetic, acoustic, electrically powered, optical, hydraulic, pneumatic, mechanical (e.g., position) etc. The sensor 270 is positioned in the passage 96, the sensor 272 is positioned on an exterior of the tubular string 256 and the sensor 274 is positioned on a well tool 276 in the passage 114.

In this embodiment, the sensors 270, 272, 274 are optical sensors, but it should be clearly understood that any type of sensors may be used instead of, or in combination with, optical sensors. The sensors 270, 272, 274 are connected to optical conductors 278, 280 attached to the tubular string 256. The conductors 278, 280 are depicted in FIG. 22 as being positioned external to the tubular string 256, but they could be contained within the tubular string, within the hydraulic conductor 268, within another control line, or otherwise positioned in keeping with the principles of the invention.

The sensor 270 is connected to the optical conductor 278 via optical connectors 282, 284, 286. The connector 282 is positioned in a sidewall of the mandrel 94, the connector 284 is positioned in a sidewall of the interior portion 102, and the connector 286 is attached to the tubular string 256.

An optical connection between the connectors 282, 284 is made when the interior portion 102 is installed in the shell 92. An optical connection between the connectors 284, 286 is made when the tubular string 256 is installed in the passage 112. These connections between the connectors 282, 284, 286 may also optically connect the conductor 278 with another conductor 288 extending downwardly through the passage 96 in the mandrel 94.

The sensor 274 is connected to the optical conductor 280 via optical connectors 290, 292, 294. The connector 290 is attached to the tubular string 256, the connector 292 is positioned in a sidewall of the interior portion 102, and the connector 294 is positioned in a sidewall of the interior portion 104.

An optical connection between the connectors 292, 294 is made when the interior portions 102, 104 are installed in the shell 92. An optical connection is made between the connectors 290, 292 when the tubular string 256 is installed in the passage 112.

The sensor 274 is included in the well tool 276, which is part of the interior portion 104. That is, the well tool 276 is installed in the shell 92 as part of the interior portion 104 and is not separate from the interior portion. If, however, it is desired to separately install the well tool 276, or to separately retrieve the well tool from the interior portion 104, another optical connector could be used between the sensor 274 and the connector 294.

The well tool 276 could be any type of well tool. For example, the well tool 276 could be a venturi flowmeter, in which case the sensor 274 could be used to sense differential pressure in the flowmeter. The well tool 276 could be a flow control device, such as a valve or choke, in which case the sensor 274 could be a position sensor to determine a position of a closure member of the device. Any combination of well tool and sensor may be used in keeping with the principles of the invention.

Although the above description of the system 90 as depicted in FIG. 22 uses optical sensors 270, 272, 274 conductors 278, 280 and connectors 282, 284, 286, 290, 292, 294, it will be readily appreciated that all, or any combination, of these could be replaced or supplemented by electrical, hydraulic, mechanical, thermal, magnetic, etc. counterparts.

It will be readily appreciated that the system 90 as depicted in FIG. 22 permits sensor indications to be transmitted between interior portions 102, 104, between each interior portion and the mandrel 94, between the well tool 276 and an interior portion, between the well tool and the mandrel, etc. For example, the sensor 274 in the well tool 276 in the interior portion 104 can transmit indications to the other interior portion 102 and to the mandrel 94.

Figure 23:
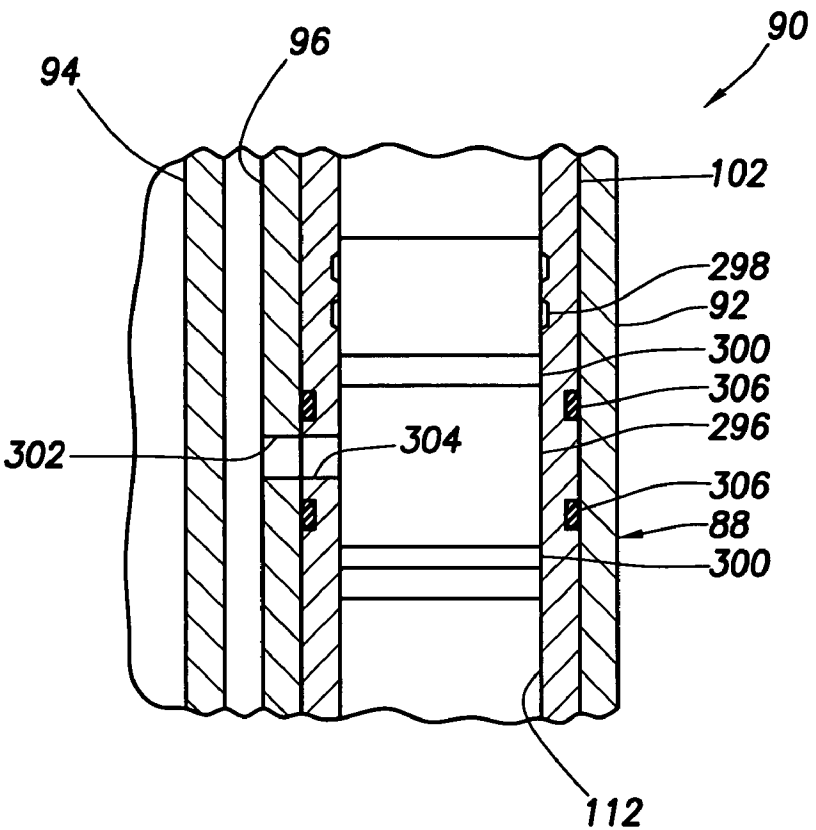
FIG. 23 is a schematic partially cross-sectional view of a seventh method of using the fourth system in a well, the method embodying principles of the invention.

Referring additionally now to FIG. 23, the system 90 is illustrated in another application in which a well tool 296 is secured and sealed in the passage 112 in the interior portion 102. Latch keys 298 releasably secure the well tool 296 in the passage 112, and seals 300 seal the well tool in the passage.

The passage 96 in the mandrel 94 is in communication with the well tool 296 via aligned openings 302, 304 formed through the sidewalls of the respective mandrel and interior portion 102. The openings 302, 304 may be aligned and placed in fluid communication when the interior portion 102 is installed in the shell 92 after it is expanded downhole.

Seals 306 on the interior portion 102 longitudinally straddle the openings 302, 304, thereby providing sealed communication therebetween. The seals 300 on the well tool 296 also longitudinally straddle the opening 304, thereby providing sealed communication between the opening and the well tool.

The well tool 296 may be any type of well tool, including any of those described above. For example, the well tool 296 could be a safety valve which is actuated by pressure transmitted from the passage 96 in the mandrel 94 to the well tool via the openings 302, 304.

As another example, the well tool 296 could be a chemical treatment tool which is supplied with treatment chemicals from the passage 96 in the mandrel 94. As yet another example, the well tool 296 could be a sensor assembly which detects properties of fluid flowing through the passage 112 and communicates indications of these properties to a remote location via electrical pulses or pressure pulses transmitted via the passage 96 in the mandrel 94.

Figure 24:
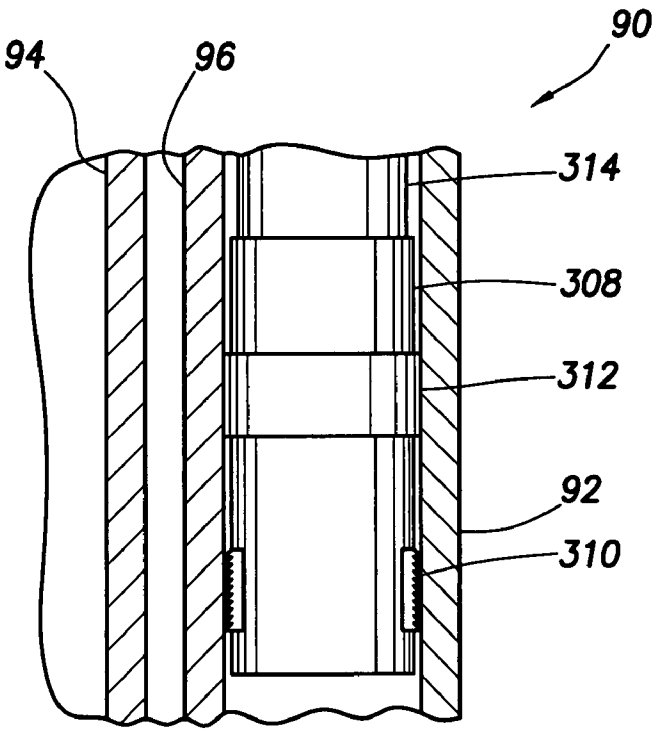
FIG. 24 is a schematic partially cross-sectional view of a eighth method of using the fourth system in a well, the method embodying principles of the invention.

Referring additionally now to FIG. 24, another application for use of the system 90 is representatively illustrated. In this application an interior portion 308 is used which is differently configured compared to the other interior portions 102, 104, 106, 108 described above.

The interior portion is secured and sealed in the expanded shell 92 by means of gripping devices 310, such as slips, and a compressible or outwardly extendable seal 312. The gripping devices 310 and seal 312 may be similar to those on conventional packers, hangers, etc.

The gripping devices 310 may grip the expanded shell 92, the mandrel 94, other interior portions 102, 104, 106, 108 or any combination of these. Similarly, the seal 312 may seal against the expanded shell 92, the mandrel 94, other interior portions 102, 104, 106, 108 or any combination of these.

The interior portion 308 may be conveyed into the expanded shell 92 by any means of conveyance, such as a tubular string 314 (e.g., a production tubing string or a coiled tubing string, etc.), or a wireline. The interior portion 308 could include any type of well tool. For example, a valve could be incorporated in the interior portion 308 to regulate flow through the system 90.

As another example, the interior portion 308 could include a storage chamber for storing treatment chemicals downhole. When the treatment chemicals are depleted, the interior portion 308 (including the storage chamber) could be retrieved for refilling or replacement, or the tubular string 314 could be used to deliver additional treatment chemicals to the storage chamber in the interior portion while it remains in the shell 92.

Although FIG. 24 depicts the gripping devices 310 on the interior portion 308 for gripping the mandrel 94, it will be readily appreciated that the gripping devices could instead be positioned on the mandrel for gripping the interior portion 308, or any other interior portion, well tool, shell 92 or other portion of the apparatus 88. The gripping devices 310 on the interior portion 308 could also grip another interior portion, well tool or other portion of the apparatus 88.

Figure 25:
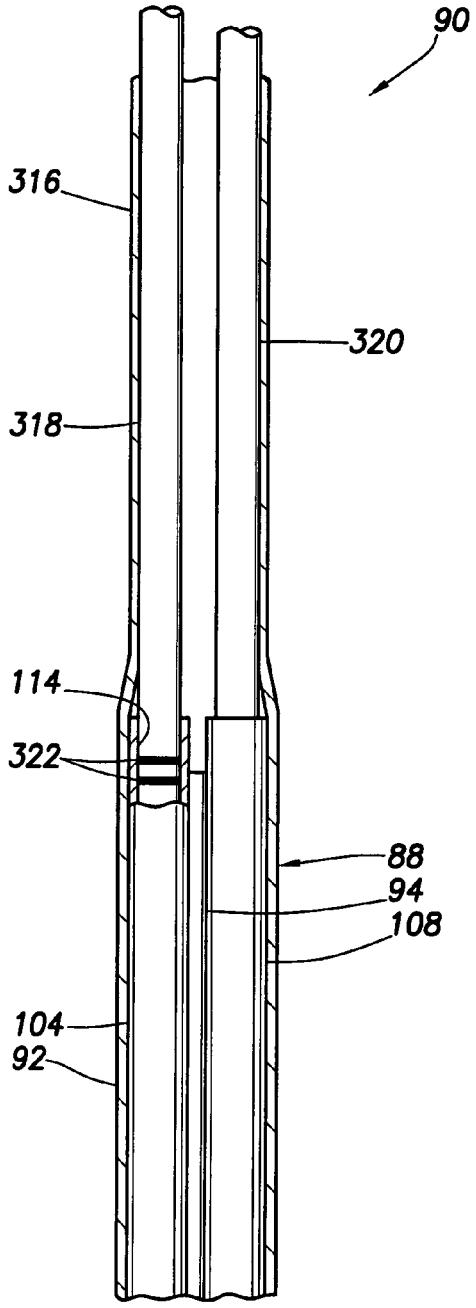
FIG. 25 is a schematic partially cross-sectional view of a ninth method of using the fourth system in a well, the method embodying principles of the invention.

Referring additionally now to FIG. 25, a schematic cross-sectional view of the system 90 is representatively illustrated. In this view, the junction apparatus 88 has been interconnected as part of a casing or liner string 316, installed in a wellbore, and the shell 92 expanded in the wellbore. The interior portions 102, 104, 106, 108 have been installed in the expanded shell 92, although only the portions 104, 108 are visible in this view.

In addition, tubular strings 318, 320 (such as production tubing strings, coiled tubing strings, steam injection lines, chemical injection lines, water flood lines, gas storage lines, other types of tubular strings and/or lines, etc.) have been sealingly engaged with the respective interior portions 104, 108. For example, a lower end of the tubular string 318 may be inserted into the passage 114 in the interior portion 104 and sealed therein using seals 322 carried on the tubular string. Similar sealing engagements may be provided for the other interior portions 102, 106, 108. Of course other types of sealing engagements may alternatively (or also) be provided.

Figure 26:
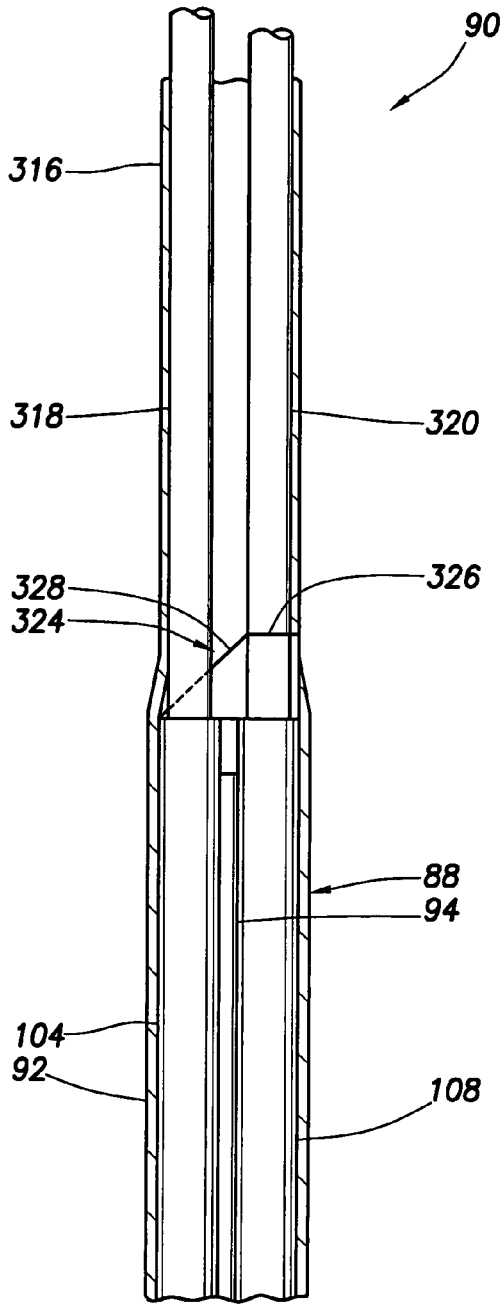
FIG. 26 is a schematic partially cross-sectional view of a tenth method of using the fourth system in a well, the method embodying principles of the invention.

Referring additionally now to FIG. 26, another cross-sectional view of the system 90 is representatively illustrated which is similar to FIG. 25. However, in FIG. 26 an orienting assembly 324 is used to direct the tubing strings 318, 320 to engage the appropriate respective ones of the interior portions 104, 108. In this manner, a tubular string may be conveyed through the casing string 316 and reliably engaged with the proper one of the interior portions 102, 104, 106, 108.

For example, the orienting assembly 324 may include an orienting device 326 carried on the tubular string 320 which engages an orienting profile 328 of the junction apparatus 88 or interconnected in the casing string 316. The orienting profile 328 could be part of a Sperry Latch Coupling available from Halliburton Energy Services, Inc., and the orienting device 326 could be a Sperry Latch, also available from Halliburton Energy Services, Inc. Other types of orienting assemblies could be used if desired, and the orienting assembly 324 could be positioned otherwise in the system 90, without departing from the principles of the invention.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A system for assembling an apparatus in a subterranean well, the system comprising:

an expandable shell; and multiple portions of the apparatus conveyed into the shell, the apparatus portions assembled within the shell forming the apparatus, and wherein the apparatus is a wellbore junction, the apparatus portions assembled within the shell providing fluid communication between multiple intersecting wellbores.

2. The system of claim 1, wherein the apparatus portions are sealed to each other in the shell.

3. The system of claim 1, wherein the apparatus portions are sealed to the shell.

4. The system of claim 1, wherein the shell is in an expanded configuration in the well when the apparatus portions are assembled within the shell.

5. The system of claim 1, wherein the apparatus portions cooperatively engage each other to position each successive apparatus portion in the shell.

6. The system of claim 1, wherein a tubular string is engaged with at least one of the apparatus portions.

7. The system of claim 1, wherein a first one of the apparatus portions is in communication with a second one of the apparatus portions.

8. The system of claim 1, further comprising a well tool positioned in at least one of the apparatus portions.

9. The system of claim 1, wherein a connector on at least one of the apparatus portions is connected to a connector on a well tool.

10. The system of claim 1, further comprising a mandrel within the shell which engages the apparatus portions to position the apparatus portions in the shell.

11. A system for assembling an apparatus in a subterranean well, the system comprising:

an expandable shell; and multiple portions of the apparatus conveyed into the shell, the apparatus portions assembled within the shell forming the apparatus, and wherein a first well tool in a first one of the apparatus portions is connected to a second well tool in a second one of the apparatus portions.

12. A system for assembling an apparatus in a subterranean well, the system comprising:

an expandable shell;

multiple portions of the apparatus conveyed into the shell, the apparatus portions assembled within the shell forming the apparatus; and a hardenable material flowed between the apparatus portions.

13. A system for assembling an apparatus in a subterranean well, the system comprising:

an expandable shell;

multiple portions of the apparatus conveyed into the shell, the apparatus portions assembled within the shell forming the apparatus; and a hardenable material flowed between the shell and at least one of the apparatus portions.

14. A method of assembling an apparatus in a subterranean well, the method comprising the steps of:

positioning an expandable shell within an enlarged cavity in a wellbore of the well;

expanding the shell in the well; and then interconnecting multiple portions of the apparatus to each other within the expanded shell.

15. The method of claim 14, further comprising the step of individually conveying the apparatus portions into the shell.

16. The method of claim 14, further comprising the step of conveying the apparatus portions into the shell together.

17. The method of claim 14, wherein the interconnecting step further comprises sealing between the apparatus portions in the shell.

18. The method of claim 14, wherein the interconnecting step further comprises sealing between the apparatus portions and the shell.

19. The method of claim 14, wherein the interconnecting step further comprises engaging each apparatus portion with at least one other apparatus portion to thereby cooperatively position each apparatus portion in the shell.

20. The method of claim 14, further comprising the step of engaging a tubular string with at least one of the apparatus portions.

21. The method of claim 14, further comprising the step of communicating between a first one of the apparatus portions and a second one of the apparatus portions.

22. The method of claim 14, further comprising the step of positioning a well tool in at least one of the apparatus portions.

23. The method of claim 14, further comprising the step of connecting a connector on at least one of the apparatus portions to a connector on a well tool.

24. The method of claim 14, further comprising the step of engaging the apparatus portions with a mandrel within the shell to position the apparatus portions in the shell.

25. A method of assembling an apparatus in a subterranean well, the method comprising the steps of:

positioning an expandable shell in the well;

expanding the shell in the well;

then interconnecting multiple portions of the apparatus to each other within the expanded shell; and drilling a wellbore through a wellbore exit passage of at least one of the apparatus portions after the interconnecting step.

26. A method of assembling an apparatus in a subterranean well, the method comprising the steps of:

positioning an expandable shell in the well;

expanding the shell in the well; and then interconnecting multiple portions of the apparatus to each other within the expanded shell, and wherein the interconnecting step further comprises forming a wellbore junction from the interconnected apparatus portions and expanded shell.

27. A method of assembling an apparatus in a subterranean well, the method comprising the steps of:

positioning an expandable shell in the well;

expanding the shell in the well;

then interconnecting multiple portions of the apparatus to each other within the expanded shell; and connecting a first well tool in a first one of the apparatus portions to a second well tool in a second one of the apparatus portions.

28. A method of assembling an apparatus in a subterranean well, the method comprising the steps of:

positioning an expandable shell in the well;

expanding the shell in the well;

then interconnecting multiple portions of the apparatus to each other within the expanded shell; and flowing a hardenable material between the apparatus portions.

29. A method of assembling an apparatus in a subterranean well, the method comprising the steps of:

positioning an expandable shell in the well;

expanding the shell in the well;

then interconnecting multiple portions of the apparatus to each other within the expanded shell; and flowing a hardenable material between the shell and at least one of the apparatus portions.

30. A method of assembling an apparatus in a subterranean well, the method comprising the steps of:

positioning an expandable shell in the well;

expanding the shell in the well; and then interconnecting multiple portions of the apparatus to each other within the expanded shell, and wherein the positioning step further comprises positioning the shell at a wellbore intersection.

* * * * *